US010324409B2

(12) United States Patent
Kobayashi

(10) Patent No.: US 10,324,409 B2
(45) Date of Patent: Jun. 18, 2019

(54) APPARATUS FOR FOLDING SHEETS, APPARATUS FOR PROCESSING SHEETS, APPARATUS FOR FORMING IMAGES AND METHOD OF FOLDING SHEETS

(71) Applicant: Misao Kobayashi, Kofu (JP)

(72) Inventor: Misao Kobayashi, Kofu (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 92 days.

(21) Appl. No.: 15/336,228

(22) Filed: Oct. 27, 2016

(65) Prior Publication Data

US 2017/0123364 A1 May 4, 2017

(30) Foreign Application Priority Data

Oct. 30, 2015 (JP) ..... 2015-213815
Oct. 30, 2015 (JP) ..... 2015-213816
Oct. 30, 2015 (JP) ..... 2015-213817
Oct. 30, 2015 (JP) ..... 2015-213818

(51) Int. Cl.

*B65H 45/12* (2006.01)
*G03G 15/00* (2006.01)
*B65H 29/00* (2006.01)
*B65H 29/12* (2006.01)
*B65H 31/10* (2006.01)

(52) U.S. Cl.

CPC ..... *G03G 15/6544* (2013.01); *B65H 29/008* (2013.01); *B65H 29/12* (2013.01); *B65H 31/10* (2013.01); *B65H 45/12* (2013.01); *B65H 2301/17* (2013.01); *B65H 2402/10* (2013.01); *B65H 2403/41* (2013.01); *B65H 2404/147* (2013.01); *B65H 2404/733* (2013.01); *B65H 2701/11238* (2013.01); *B65H 2801/27* (2013.01); *G03G 2215/00877* (2013.01)

(58) Field of Classification Search

CPC ..... B65H 45/145; B65H 2404/733; B65H 45/12; B65H 45/14; G03G 2215/00877
See application file for complete search history.

(56) References Cited

U.S. PATENT DOCUMENTS 4,917,662 A * 4/1990 Gombault ..... B41F 13/60 493/416
5,261,985 A * 11/1993 Lin ..... B65H 45/12 156/218
2007/0099785 A1* 5/2007 Micallef ..... B65H 45/12 493/405
2012/0004086 A1* 1/2012 Shirakura ..... B65H 45/12 493/454

FOREIGN PATENT DOCUMENTS

JP 5218836 B2 6/2013
JP 5595009 B2 9/2014

* cited by examiner

*Primary Examiner* — Jennifer E Simmons
(74) *Attorney, Agent, or Firm* — Manabu Kanesaka

(57) ABSTRACT

A sheet folding apparatus for folding a sheet is provided with a hold member that holds a transported sheet in a substantially cylindrical shape, a shift member that presses the outer circumferential surface of the sheet of the substantially cylindrical shape held by the hold member to make a substantially flat shape, and a discharge section that further presses the sheet made the substantially flat shape by the shift member, while discharging in a direction crossing a transport direction. By this means, it is possible to provide a relatively compact sheet folding apparatus.

25 Claims, 18 Drawing Sheets

APPARATUS FOR FOLDING SHEETS, APPARATUS FOR PROCESSING SHEETS, APPARATUS FOR FORMING IMAGES AND METHOD OF FOLDING SHEETS

BACKGROUND OF THE INVENTION

1. Field of the Invention

The present invention relates to a sheet folding apparatus for folding a sheet discharged from an image formation apparatus such as a copier and various types of printers, and more particularly, to a sheet folding apparatus, sheet processing apparatus, image formation apparatus and method of folding a sheet particularly for enabling compact folding to be executed.

2. Description of the Related Art

Generally, a folding apparatus is widely known where folding processing is performed, in a predetermined, on a sheet carried out of an image formation apparatus.

In addition, in recent years, such an apparatus has also been provided that the apparatus is connected to an image formation apparatus, and is disposed before a post-processing apparatus, for example, binding apparatus to perform folding processing on a sheet.

For example, Japanese Patent Gazette No. 5218836 shows a folding apparatus which is positioned between an image formation section and a post-processing apparatus and in which are disposed a transport path for guiding an image-formed sheet transported from the image formation section, three folding rollers positioned in the transport path to mutually come into press-contact, a front end stopper for regulating a sheet front end, and a folding blade for pushing the regulated sheet into among three folding rollers. Then, the folding apparatus indicates a sheet folding apparatus for repeating switchback transport of a sheet sequentially, passing the sheet through three folding rollers sequentially, and performing folding processing.

Further, Japanese Patent Gazette No. 5595009 also shows a sheet folding apparatus which is disposed before a post-processing apparatus for binding sheets, transports an image-formed sheet discharged from an image formation section once to a curved transport path, presses the sheet subjected to curve transport against three rollers mutually brought into press-contact with a deflection member, and thereby performs folding processing.

The sheet folding apparatuses shown in above-mentioned Japanese Patent Gazettes No. 5218836 and No. 5595009 require a relatively long transport path to hold a sheet length undergoing folding processing. Further, in any of the sheet folding apparatuses, the folding processing is performed by repeating operation for feeding a sheet in one direction, and carrying in three rollers, while performing switchback transport.

In addition, the folding apparatus shown in above-mentioned Japanese Patent Gazette No. 5595009 is comprised of a transport path curved above and below three rollers, is thereby made relatively smaller than the folding apparatus of Japanese Patent Gazette No. 5218836 comprised of a linear transport path, but needs a transport path over the entire length of a curved sheet.

Thus, the apparatus basically has a transport path corresponding to the sheet transport length, and further, since the folding processing is performed while switchback-transporting a sheet, requires the complicated sheet transport path with fluctuations in transport.

Particularly, in order to support the recent so-called in-body type where an apparatus for processing sheets is installed in discharge space from a reading apparatus disposed above an image formation section, miniaturization has not been attained to the extent that the apparatus is disposed in this space.

SUMMARY OF THE INVENTION

The present invention was made based on the above-mentioned issue, and it is an object of the invention to provide a sheet folding apparatus which does not need a transport path along a transport length of a sheet to perform folding processing, further does not perform complicated switchback transport of a sheet, and is capable of performing folding processing relatively in a compact manner with ease.

In order to attain the above-mentioned object, according to the first disclosure of the present invention, the following configuration is adopted. A sheet folding apparatus for folding a sheet is provided with a hold member that holds a sheet in a substantially cylindrical shape, a shift member that presses an outer circumferential surface of the sheet of the substantially cylindrical shape held by the hold member to make a substantially flat shape, and a discharge section that further presses the sheet made the substantially flat shape by the shift member, while discharging in an outer circumferential edge direction of the sheet.

According to the second disclosure, the following configuration is adopted. A sheet folding apparatus for folding a sheet is comprised of a transport roller that transports a sheet, a hold member made of a deformable flexible sheet that overlaps a front end and a rear end of the sheet transported by the transport roller to hold in a substantially cylindrical shape, folding rollers positioned in a sheet end portion of the hold member to come into contact with the sheet held in the substantially cylindrical shape by the hold member to rotate, while being capable of separating from each other, and a shift member which presses the sheet of the substantially cylindrical shape held by the hold member from opposite sides of a sheet outer circumferential surface together with the hold member to deform into a substantially flat shape, while shifting to the folding rollers side.

According to the third disclosure, the following configuration is adopted. A sheet processing apparatus for processing a discharged sheet includes a folding unit including a folding processing section branched off from a transport path for transporting a sheet to a downstream side to perform folding processing on a sheet, a binding unit including a binding processing section that performs binding processing on sheets as a bunch obtained by temporarily placing sheets transported from the folding unit, and a tray unit including a collection tray capable of moving up and down to collect a bunch of sheets subjected to the binding processing in the binding unit, where the folding processing section is provided with a hold member that holds a sheet fed from the transport path in a substantially cylindrical shape, and folding rollers that fold the sheet made the substantially cylindrical shape by the hold member in a direction crossing a sheet transport direction of the transport path, while discharging.

According to the fourth disclosure, the following method is adopted. A sheet folding method of folding a sheet is provided with a hold step of holding a transported sheet in a substantially cylindrical shape, a shift step of pressing an outer circumferential surface of the sheet of the substantially cylindrical shape formed in the hold step to make a substantially flat shape, and a discharge step of further pressing the sheet made the substantially flat shape in the shift step, and folding in a direction crossing a transport direction, while discharging.

According to each of above-mentioned disclosures, it is possible to provide a relatively compact apparatus and folding method capable of performing folding processing without using a transport path along a sheet length and three folding rollers in press-contact, with a folding mechanism for pressing a sheet held in a substantially cylindrical shape into a substantially flat shape, while discharging.

BRIEF DESCRIPTION OF THE DRAWINGS

FIG. 12A illustrates a state where a sheet is held in a cylindrical shape, and FIG. 12B illustrates a state subjected to folding processing;

FIG. 16A is an explanatory view of a state where the backside is the outside by winding to the left as show in FIG. 5, and FIG. 16B an explanatory view of a state where the frontside is the outside by winding to the right as show in FIG. 14;

FIG. 17A illustrates a state where a sheet is held in the substantially cylindrical shape, and FIG. 17B illustrates a state of the folded sheet subjected to folding processing.

DESCRIPTION OF THE EMBODIMENTS

Referring to drawings, described below are a sheet processing apparatus B including a folding unit 31 as a sheet folding apparatus according to the present invention, and an image formation apparatus A to attach the apparatus B.

Figure 1:
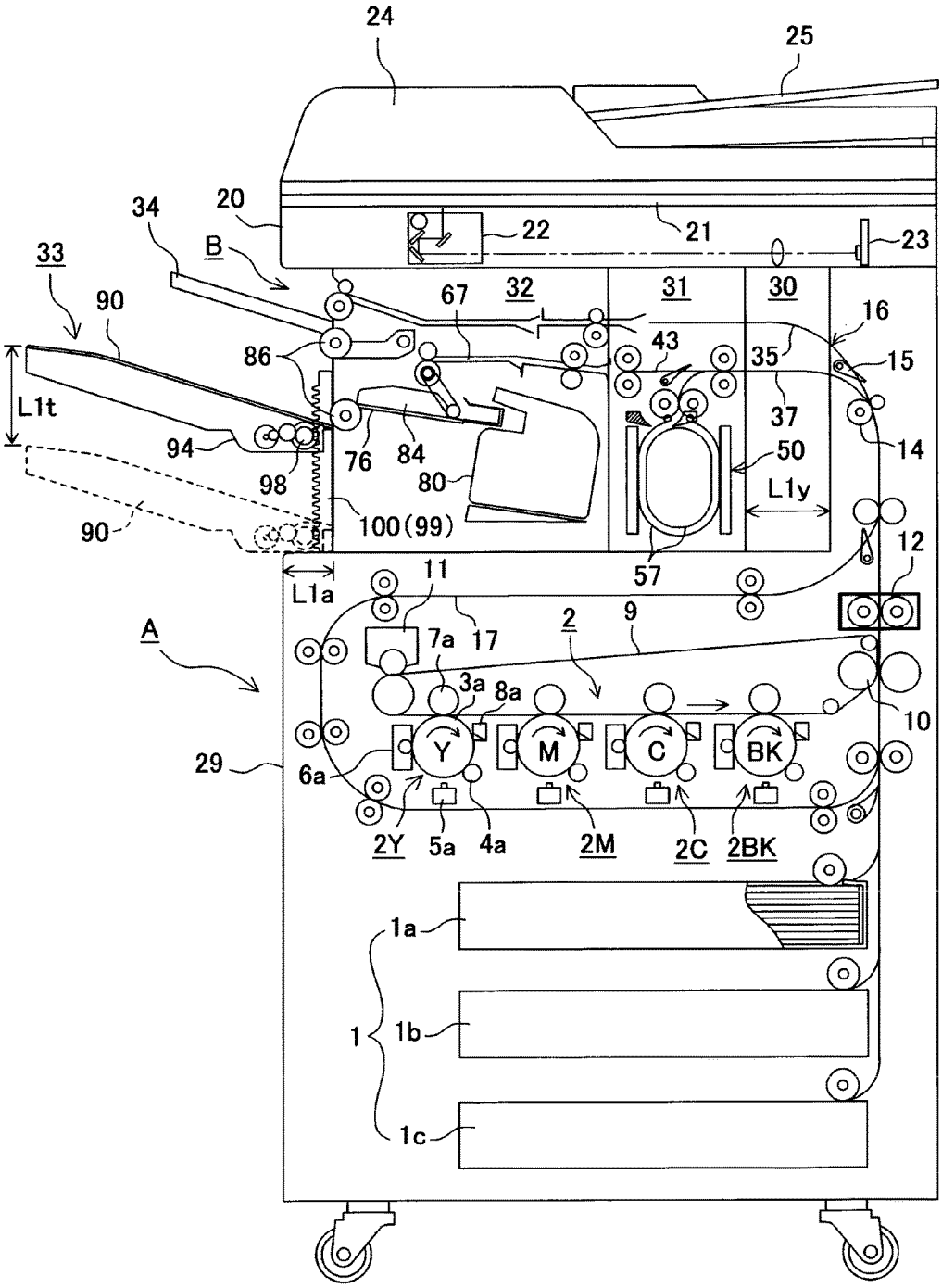
FIG. 1 is an explanatory view illustrating an entire configuration with a folding unit that is a sheet folding apparatus according to the present invention and an image formation apparatus combined.
Figure 2:
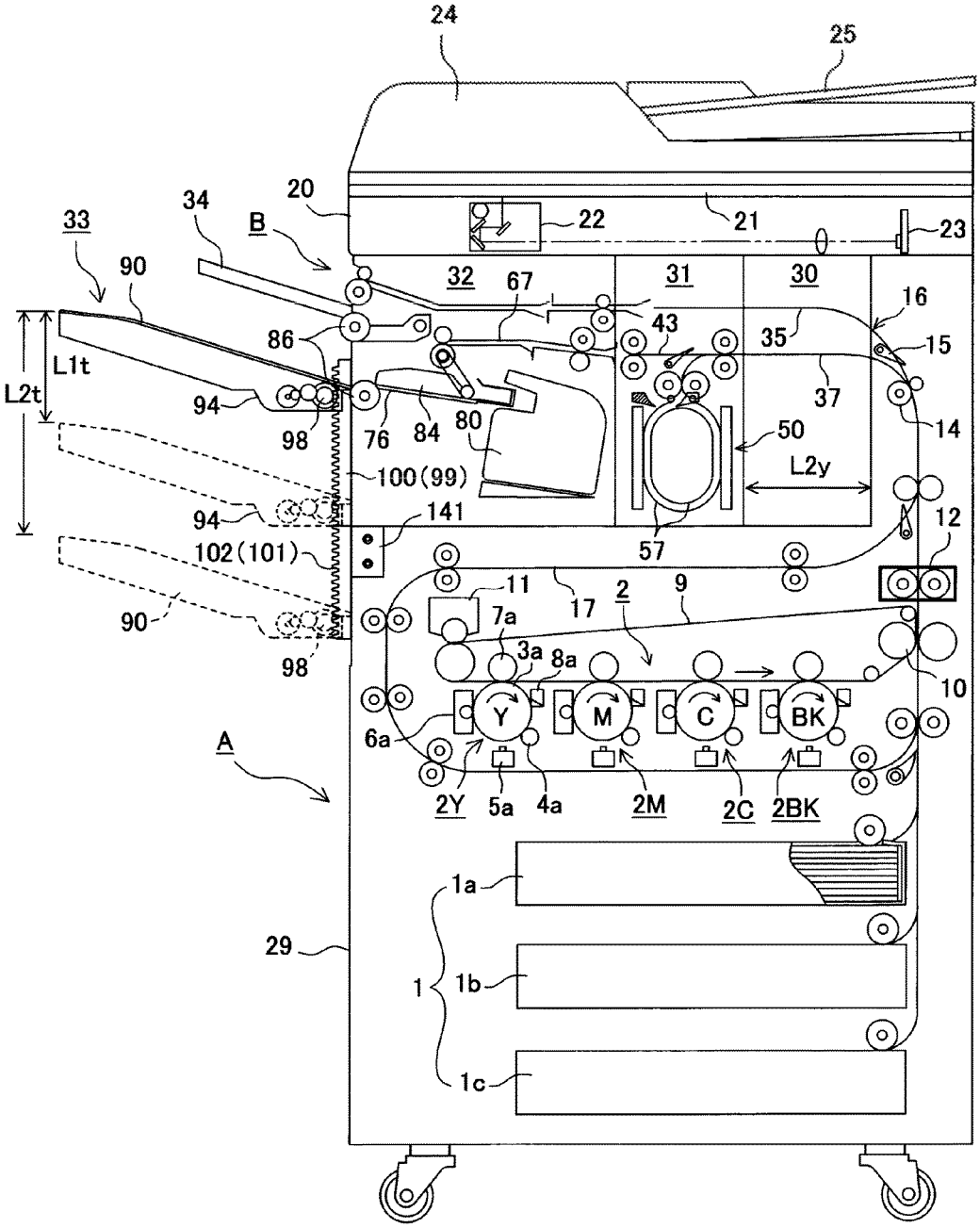
FIG. 2 is an explanatory view illustrating an entire configuration with the folding unit according to the invention, a tray unit with an up-and-down range extended and the image formation apparatus combined.

FIG. 1 is an explanatory view illustrating an entire configuration of the sheet processing apparatus B including the folding unit 31 according to the present invention and the image formation apparatus A. FIG. 2 is an explanatory view illustrating an entire configuration obtained by combining the sheet processing apparatus B, with an up-and-down range of a collection tray 90 extended, having the folding unit 31 according to the present invention and the image formation apparatus A.

[Image Formation Apparatus A]

The image formation apparatus A shown in FIGS. 1 and 2 uses an electrophotographic scheme, and a paper feed section comprised of three-stage paper feed cassettes 1*a*, 1*b*, 1*c* to store sheets are disposed below an image formation section 2. When the sheet processing apparatus B is not inserted, space above the image formation section 2 is sheet discharge space, and an image reading apparatus 20 is disposed above the space. Accordingly, when the sheet processing apparatus B is disposed, the apparatus is the so-called in-body type using the sheet discharge space.

The image formation section 2 adopts a tandem scheme using an intermediate transfer belt. In other words, color components of four colors (yellow 2Y, magenta 2M, cyan 2C and black 2BK) are used. For example, in yellow 2Y, the section 2 has a photoconductor drum 3*a* as an image support body, a charging apparatus 4*a* comprised of a charging roller that charges the photoconductor drum 3*a*, and an exposure apparatus 5*a* that makes an image signal read with the image reading apparatus 20 a latent image. Further, the section 2 is provided with a development apparatus 6*a* that forms the latent image formed on the photoconductor drum 3*a* as a toner image, and a first transfer roller 7*a* that first-transfers the image on the photoconductor drum 3*a* formed by the development apparatus 6*a* to an intermediate transfer belt 9. This configuration is first-transferred to the intermediate transfer belt for each color component. The color component left on the photoconductor drum 3*a* is collected by a photoconductor cleaner 8*a* to prepare for next image formation. These schemes are the same as in the other color components as shown in FIGS. 1 and 2.

In addition, an image of the intermediate transfer belt 9 is transferred to a sheet fed from the paper feed section 1 by a second-transfer roller 10, and the image is fused to the sheet by pressurized force and heat by a fusing apparatus 12. The remaining superimposed color components on the intermediate transfer belt 9 are removed by an intermediate belt cleaner 11 to prepare for next transfer.

Thus image-formed sheet is fed to a main-body discharge outlet 16 by a main-body discharge roller 14. When image formation is performed on both sides of a sheet, the sheet once transported to the sheet processing apparatus B side with a switch gate 15 is switched back, transported to a circulation path 17, and is fed to the image formation section 2 again to form an image on the backside of the sheet.

The sheet with the image thus formed on one side or both sides is transported to the sheet processing apparatus B including the folding unit 31 through the main-body discharge roller 14.

In addition, the image reading apparatus 20 is disposed above the sheet discharge space above the image formation section 2. Herein, an original document placed on an original document stacker 25 is fed to platen 21 with an original document feeding apparatus 24, the fed original document is sequentially read with a photoelectric converter (for example, CCD) 23 by irradiating using a scan unit 22, and the image is stored in a data storage section not shown. The stored image is formed on the sheet in the image formation section as described above.

[Sheet Processing Apparatus B]

Described next is the sheet processing apparatus B disposed in the sheet discharge space below the image reading apparatus 20, above the image formation section 2 of FIGS. 1 and 2. As a part of the sheet processing apparatus B, the folding unit 31 is provided as a sheet folding apparatus that folds a sheet according to the invention.

In the sheet processing apparatus B are disposed a guide unit 30 for feeding a sheet discharged from the main-body sheet discharge outlet 16 to an apparatus on the downstream side or guiding a sheet undergoing switchback to form images on the both sides, the folding unit 31 for folding a sheet, for example, in three, a binding unit 32 for temporarily placing sequentially transported image-formed sheets on a processing tray 76 as a bunch to bind with a stapler 80, and a tray unit 33 having a collection tray 90 for collecting bunches of sheets bound by the binding unit 32 and sheets discharged without being bound and moving up and down.

In addition, the guide unit 30, folding unit 31, and binding unit 32 having the tray unit 33 constituting the sheet processing apparatus B are capable of being disposed selectively, and for example, it is possible to place only the binding unit 32 and folding unit or omit the unit.

In addition, in the tray unit 33 having the collection tray 90 that moves up and down, in FIG. 1, the collection tray 90 moves up and down with respect to an up-and-down rack 100, while the binding unit 32 is in a position inside an apparatus frame 29 of the image formation apparatus A corresponding to L1*a* from a staple. Accordingly, since the sheet processing apparatus B is disposed in the sheet discharge space, the entire image formation apparatus A is made compact. Therefore, for example, when only the binding unit 32 is placed in the sheet discharge space, the collection tray 90 that moves up and down is also positioned in the sheet discharge space, and it is thereby possible to make the apparatus more compact.

On the other hand, in the apparatus shown in FIG. 1 in this case, a shift range in which the collection tray 90 moves up and down is a range of L1*t* range up to the upper surface of the apparatus frame 29. Generally, this L1*t* range is set at about 500 sheets to 1000 sheets as a collection amount of sheets, and in the case where sheets exceed the range, the image formation apparatus A is halted to remove sheets placed on the collection tray 90 or to replace with a completely different sheet processing apparatus B capable of being externally installed on the apparatus frame 29.

Therefore, in the collection tray 90 disclosed in FIG. 2, an extension rack 102 capable of extending the up-and-down range with ease is added to the conventional up-and-down rack 100 (up-and-down rail 99), and illustrated is an apparatus that increases a sheet collection amount on the collection tray 90. The mechanism to extend will be described later, and by adding the extension rack 102 (extension rail 101), it is possible to increase the collection amount of sheets by about 500 sheets to 1000 sheets.

Herein, in order to add the extension rack 102 and enable the collection tray 90 to shift downward to the extension rack 102, first, the guide unit 30 having a length of L1*y* in the transport direction in FIG. 1 is replaced with the guide unit 30 having a length of L2*y*in the transport direction in FIG. 2. The length of L2*y* herein is to eliminate the distance L1*a* between the binding apparatus side surface and the side surface of the apparatus frame 29 in FIG. 1 and make a position in which the up-and-down rack 100 and the extension rail 101 are connected.

Described below are the folding unit 31 constituting a part of the sheet processing apparatus B, the binding unit 32, the tray unit 33 installed in the unit 32, and an up-and-down mechanism of the collection tray 90 of the tray unit 33, and subsequently, the extension rail including the extension rack 102 will be described also.

In addition, the guide unit 30 is shown as a unit for guiding transport of a sheet to adjust the length in the transport direction of the sheet processing apparatus B, and inside the unit, for example, a punch unit for punching a hole in a sheet, stamp unit for putting a stamp and an emboss unit for adding concavities and convexities to a sheet may be disposed alone or in combination.

[Folding Unit 31]

Herein, the folding unit 31 that is the sheet folding apparatus according to the present invention will be described. In addition, the summary of the folding unit 31 will be described herein, and the unit will specifically be described from FIG. 4.

Figure 3:
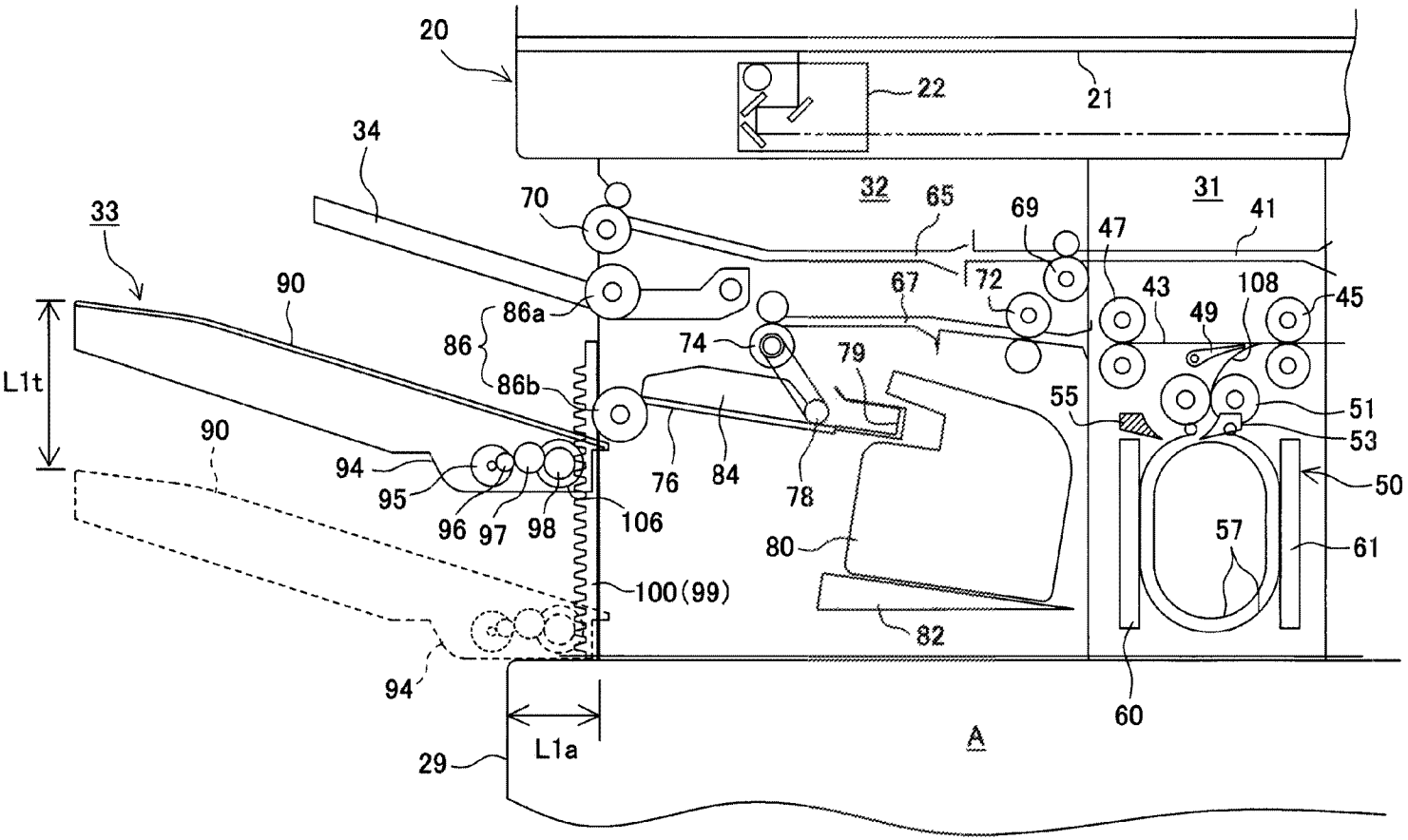
FIG. 3 is an explanatory view illustrating a sheet processing apparatus including the folding unit shown in FIG. 1.

FIG. 3 is an enlarged explanatory view of the folding unit 31, binding unit 32 and tray unit 33 installed in the unit 32 constituting a part of the sheet processing apparatus B of FIG. 1. The sheet processing apparatus B in FIG. 2 is the same as in FIG. 3 except extension of the shift range of the collection tray 90.

First, among paths continued to a switchback path 35 and a transport path 37 of the guide unit 30 from the main-body discharge outlet 16, in a folding transport path 43 in the lower stage are disposed entrance rollers 45 and exit rollers 47. A switching flapper 49 is provided between the entrance roller 45 and the exit roller 47, and by the switching flapper 49, it is configured that folding processing is performed in a substantially cylindrical shape folding section 50 without transporting a sheet to the subsequent binding unit 32.

In addition, in the upper stage is provided a folding switchback path 41 connected to the guide unit 30 shown in FIGS. 1 and 2.

The substantially cylindrical shape folding section 50 enables carry-in rollers 51 that are transport rollers of the present invention and that carry a sheet in the substantially cylindrical shape folding section 50, and first gates 53 and second gates 55 that determine a winding direction of a sheet with respect to the substantially cylindrical shape folding section to shift to actuation positions selectively. For example, by the first gate 53, a sheet is wound around a substantially cylindrical shape formation section 57 in a substantially cylindrical shape in a counterclockwise direction as viewed in the figure. The substantially cylindrical shape formation section 57 is formed of a deformable sheet member, and winds a sheet, for example, in a state in which three faces are overlapped in a substantially cylindrical shape. Then, in the state where the sheet is wound around the substantially cylindrical shape formation section, when shift members 60, 61 positioned on the opposite sides shift in mutually approaching directions, the wound sheet is also made a vertically flat shape of elliptical cross section. By pulling out the wound sheet with cylindrical rollers, not shown, in this state, the folded sheet is obtained. Details will be described from FIG. 4.

Herein, the "substantially cylindrical shape" referred to as in the invention refers to a substantially cylindrical shape in the shape shown in FIG. 12A, 16 or 17A described later, and it is assumed that the "substantially flat shape" is an shape between FIGS. 12A and 12B or FIGS. 17A and 17B, and refers to a sheet in the shape narrow in the horizontal direction and extended in the vertical direction with a narrower distance than the substantially cylindrical shape obtained by pressing the substantially cylindrical sheet of almost elliptical cross section from the opposite sides. Further, the "outer circumferential surface" refers to an arc surface of the substantially cylindrical shape, and an outer circumferential edge refers to an edge in the sheet width direction crossing the winding direction.

[Binding Unit 32]

Successively, the binding unit 32 will be described which binds sheets transported from the folding unit 31, without performing folding processing in the folding unit 31 in FIG. 3.

Also in the binding unit 32, in the upper stage is provided a binding switchback path 65 connected to the folding switchback path 41, a transport roller 69 is disposed on the entrance side, and a discharge roller 70 is disposed on the exit side. The binding switchback path 65 functions as a path for switching back to the image formation section 2 to form an image on the backside, and when necessary, is also capable of discharging a sheet such as a thick sheet unsuitable for both sides or binding processing to an escape tray 34 positioned above the tray unit 33 with the discharge roller 70. In addition, as the folding switchback path 41 and binding switchback path 65, an upper cover of each unit may be used for the path for switchback.

Below the binding switchback path 65 is provided a binding transport path 67 connected to the folding transport path 43 of the folding unit 31. On the entrance side of the binding transport path 67 are provided a binding carry-in roller 72 and carrying-out roller 74 for discharging a sheet to the processing tray 76 or collection tray 90. When the sheet discharged from the carrying-out roller 74 is temporarily placed on the processing tray 76 as a bunch, a bunch discharge roller 86 that also functions for discharge of a bunch is rotated in a counterclockwise direction (direction of a reference surface 79) in a state of nipping the sheet, a take-in roller 78 that rotates in a counterclockwise direction in cooperation with the roller 78 is rotated, and the sheet is transported until the sheet comes into contact with the reference surface 79. Concurrently therewith, a pair of alignment plates 84 positioned in a sheet width direction of the processing tray 76 are brought into contact with the sheet side edges to align the sheet.

This operation is repeated until the number of sheets reaches the number of binding sheets, and when reaching the number of binding sheets, at this point, the stapler 80 is shifted to a predetermined position of a shift bench 82 to perform binding processing. A bunch of sheets with a designated portion subjected to the binding processing by the stapler 80 is discharged to the collection tray 90 by shifting the reference surface 79 not shown to the collection tray 90 side, and bringing an up-and-down bunch discharge roller 86*a* into press-contact with a lower bunch discharge roller 86*b* fixed to the discharge side of the processing tray 79.

[Tray Unit 33]

A bunch of sheets or each sheet discharged by the bunch discharge roller 86 is collected in the tray unit 33 having the collection tray 90 moving up and down. The collection tray 90 moves up and down by up-and-down pinions 98 of the collection tray 90 rotation-engaging in up-and-down racks 100 constituting a part of up-and-down rails 99 that are shift rails described later. The up-and-down pinion 98 is driven by an up-and-down motor 95 positioned in an up-and-down motor installation portion 94 below the collection tray 90 via a transmission gear 97 and the like.

As described already, the range of up-and-down of the collection tray 90 shown in FIG. 3 is the L1*t* range, because the sheet processing apparatus B including the binding unit 32 is positioned inside the body corresponding to L1*a* from the side portion of the apparatus frame 29. Then, by providing the extension rail 101 shown in FIG. 2, it is possible to extend the up-and-down range of the collection tray 90, and it is possible to increase a collection amount of sheets.

In addition, the extension rail 101 is fixed by an extension rail attachment portion 141 to fix to the apparatus frame 29 of the image formation apparatus A and the sheet processing apparatus B, and the attachment may be made only to the sheet processing apparatus B.

Figure 4:
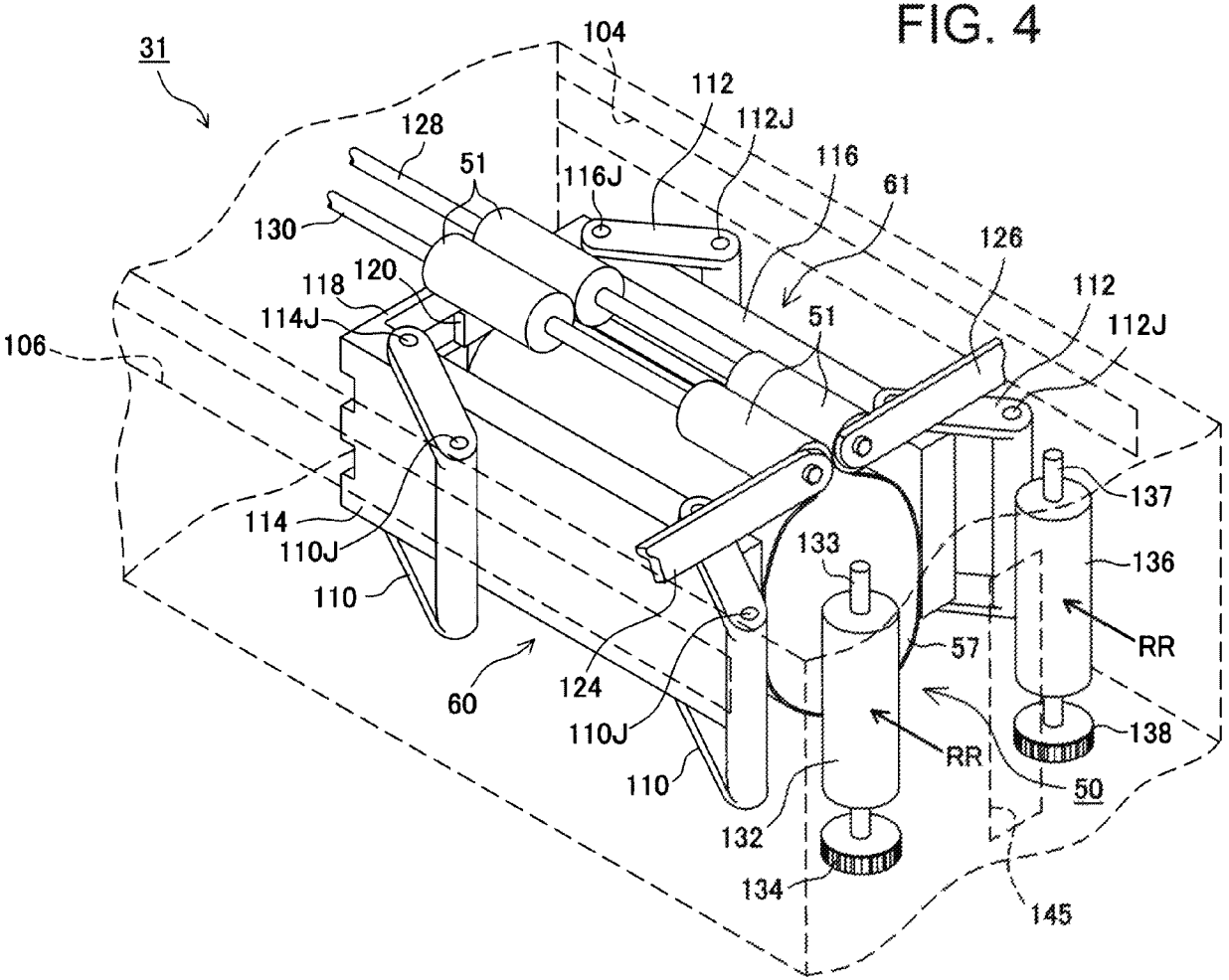
FIG. 4 is a perspective view illustrating a principal portion inside the folding unit of FIG. 3.

Hereinafter, the folding unit 31 will specifically be described as the sheet folding apparatus constituting a part of the sheet processing apparatus B. FIG. 4 is a perspective view of the substantially cylindrical shape folding section (folding processing section) 50 of the folding unit 31, and FIG. 5 is a cross-sectional explanatory view of the folding unit 31.

[Substantially Cylindrical Shape Folding Section (Folding Processing Section) 50]

Figure 5:
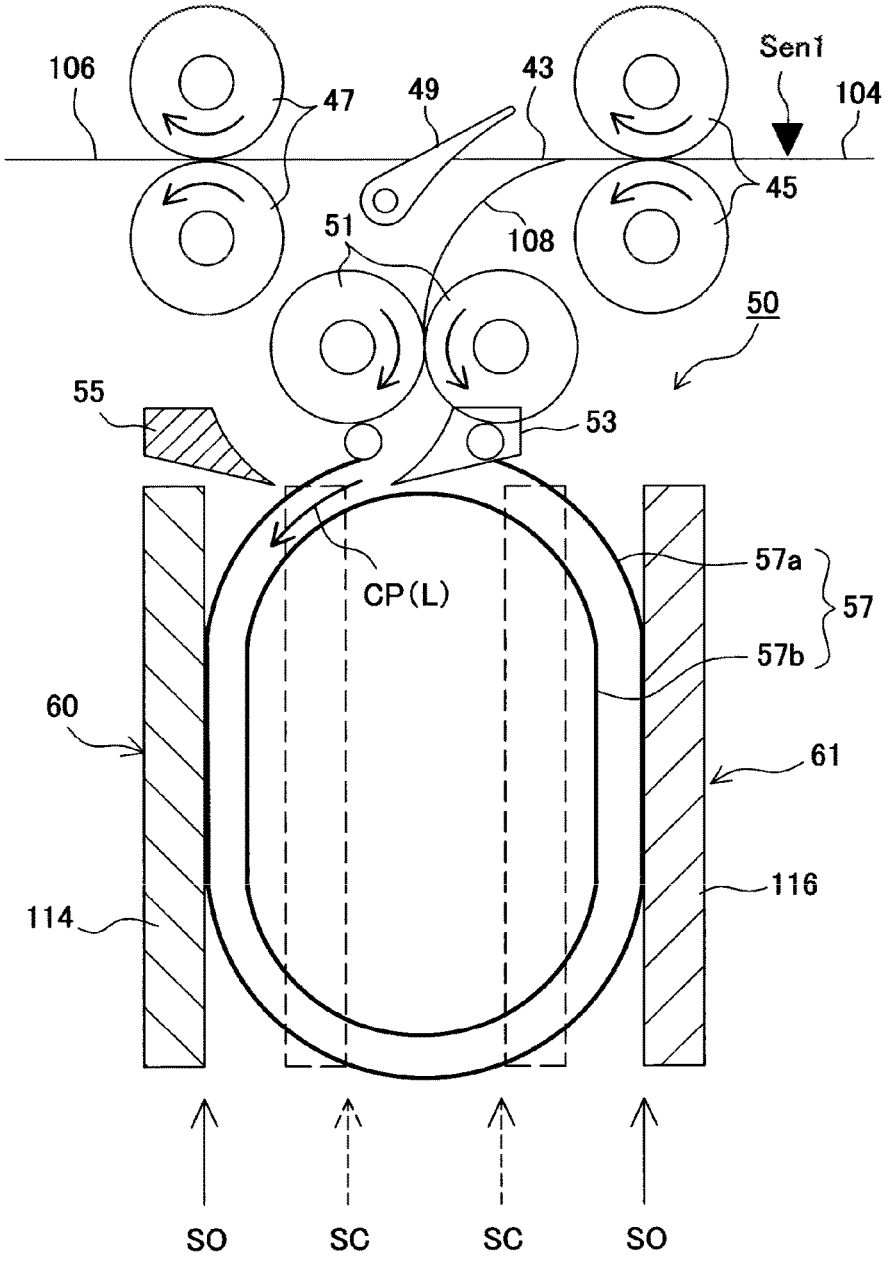
FIG. 5 is a cross-sectional explanatory view of the folding unit of FIG. 3.

As shown in FIGS. 4 and 5, the substantially cylindrical shape folding section (folding processing section) 50 is to transport on the folding transport path 43 by the entrance rollers 45 from a folding carry-in entrance 104 connected to the folding transport path 43 of the guide unit. The exit rollers 47 are positioned on the exit side of the folding transport path 43 to feed a sheet to the subsequent binding unit 32. The sheet to carry in is detected by a sheet carry-in sensor Sen1.

When a sheet is transported to the folding processing section 50 that is the substantially cylindrical shape folding section for forming the sheet in the substantially cylindrical shape, without feeding the sheet to the binding unit 32, the switching flapper 49 that shifts by a solenoid not shown shifts to a position shown in FIG. 5. By this means, the sheet transported by the exit rollers 45 is guided to a folding introduction path 108, and is carried in the substantially cylindrical shape formation section 57. FIG. 4 illustrates, as a perspective view, that the substantially cylindrical shape formation section 57 constituting the substantially cylindrical shape folding section 50 is positioned below the entrance rollers 45 and exit rollers 47 of the folding unit 31, and forms the sheet carried in around its center by carry-in rollers 51 in the substantially cylindrical shape.

[Substantially Cylindrical Shape Formation Section 57]

Figure 12A:
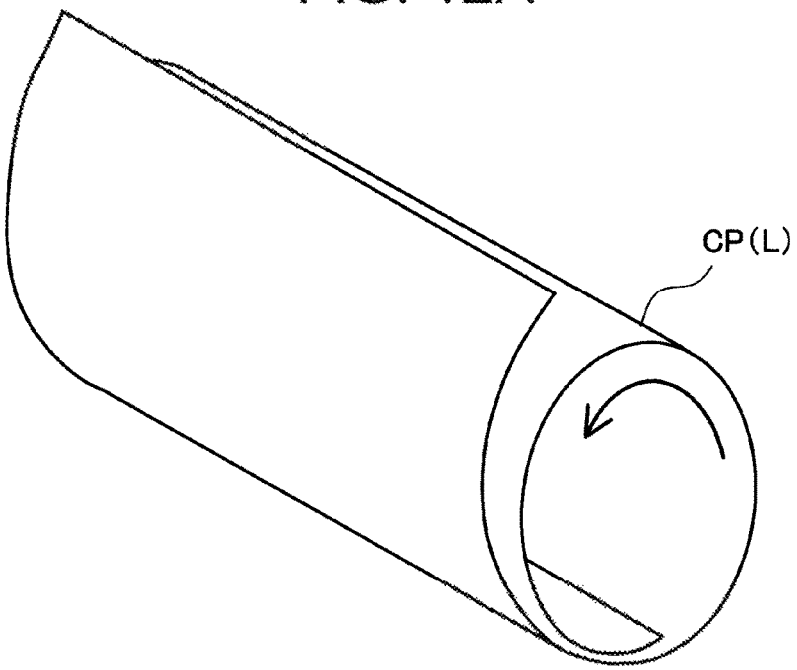
FIGS. 12A and 12B contain state views illustrating a sheet to perform folding processing in FIGS. 4 to 11, where
Figure 17A:
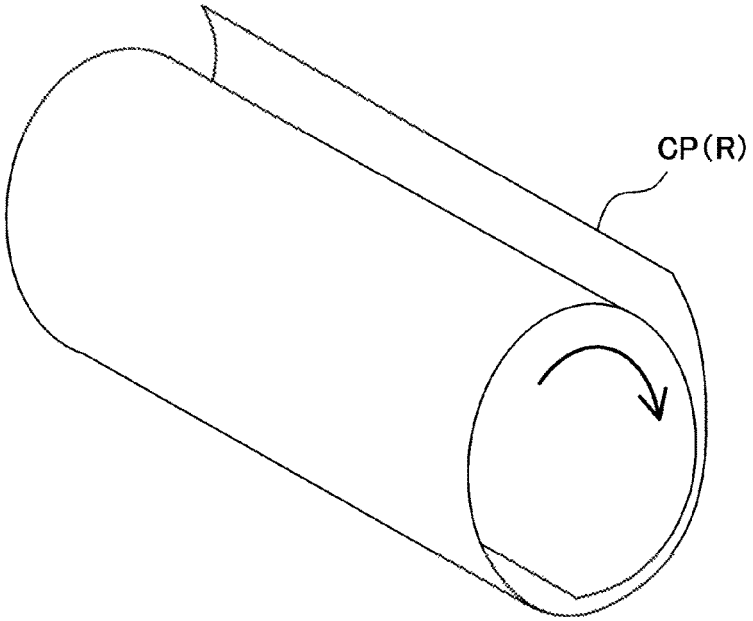
FIGS. 17A and 17B contain state views illustrating a sheet to perform folding processing as shown in FIG. 14, where

The substantially cylindrical shape formation section 57 forms a sheet in the substantially cylindrical shape to hold, and makes a substantially cylindrical state substantially in the shape of a cylinder, for example, as shown in FIG. 12A or 17A. In the apparatus shown in FIG. 5, the first gate 53 on the left in FIG. 5 is positioned as a guide gate between the carry-in roller 51 and the substantially cylindrical shape formation section 57, and by this means, the sheet is transported in a counterclockwise direction (to the left/CP (L)) as viewed in the figure.

The substantially cylindrical shape formation section 57 is comprised of an outer guide 57*a* made of a flexible sheet material (for example, polyester film sheet) with its end portion attached to a frame of the folding unit 31, and an inner guide 57*b* with its portions attached to rear end push-out members 118, 119 respectively of shift members 60, 61 described later, while being spaced apart from the guide 57*a*. The inner guide 57*b* is also made of the same material as that of the outer guide 57*a*, and when external forces are applied to the outer guide 57*a* and inner guide 57*b*, the guides are deformed.

In addition, for the sake of convenience, FIG. 4 illustrates only the outer guide, and corresponding to a sheet, the outer guide is only required. It is essential only that the guide forms a sheet transported by the carry-in rollers 51 in the substantially cylindrical shape, and is made of a material and shape that enable the shape to be deformable by applying a force.

[Shift Members (Left Shift Portion 60, Right Shift Portion 61)]

The shift members (left shift portion 60, right shift portion 61) will be described which press the sheet made the substantially cylindrical shape in the substantially cylindrical shape formation section 57 in a direction (direction crossing the substantially cylindrical shape) crossing a sheet width direction to deform the sheet into the substantially flat shape.

First, in the left shift portion 60, a left shift plate 114 made of a plate press member extends in the sheet width direction. The shape is the same as in the right shift portion 61, and a right shift plate 116 made of a plate press member is disposed.

As shown in FIG. 5, the members are configured to approach and separate between shift plate release positions SO for receiving the sheet made the substantially cylindrical shape in the substantially cylindrical shape formation section 57, and shift plate pressing positions SC positions for mutually approaching to deform the substantially cylindrical shape into the substantially flat shape of elliptical cross section.

In this configuration, as shown in FIG. 4 specifically, in front and rear two portions, approach/separation is implemented by left link portions 110 in each of which one end is axially supported by the frame of the folding unit 31 on a left link shaft 110J, and the other end is supported by the left shift plate 114 on a left shift plate support shaft 114J. Further, also the right shift plate 116 is shifted by right link portions 112 axially supported by right link shafts 112J with the other ends supporting the right shift plate 116 by right shift plate support shafts 116J.

By the link mechanism, the left shift plate 114 of the left shift portion 60 and the right shift plate 116 of the right shift portion 61 mutually approach and separate between the shift plate release positions SO and the shift plate pressing positions SC.

Further, each of the shift members (left shift portion 60, right shift portion 61) has the rear end push-out member (left rear end push-out portion 118, right rear end push-out portion 120) which is formed of an L-shaped member, and engages in the rear end edge in a discharge direction of the sheet to push out in making the sheet of the substantially cylindrical shape the substantially flat shape and shifting the sheet in the discharge direction.

Further, on the discharge side to which the shift member (left shift portion 60, right shift portion 61) pushes out, mutually approach/separation-capable folding rollers (left folding roller 132, right folding roller 136) are disposed on the front side with a folded sheet exit 145 therebetween. The left folding roller 132 and right folding roller 136 come into press-contact with each other to form the sheet made the substantially flat shape into a folded sheet shown in FIGS. 12B and 17B. Further, the left folding roller 132 and right folding roller 136 also function as discharge rollers to discharge the folded sheet from the folding unit 31.

In addition, in this Embodiment, the sheet has overlapping of about one-third in the substantially cylindrical shape, and therefore, the left folding roller 132 and right folding roller 136 are set to be longer slightly than one-third the sheet length. By this means, as compared with the roller set to be longer than the entire sheet width direction like the conventional folding apparatus, it is possible to make compact.

Configurations and drive mechanisms of the shift members (left shift portion 60, right shift portion 61) and folding rollers (left folding roller 132, right folding roller 136) will be described with reference to FIGS. 6 to 8.

Figure 6:
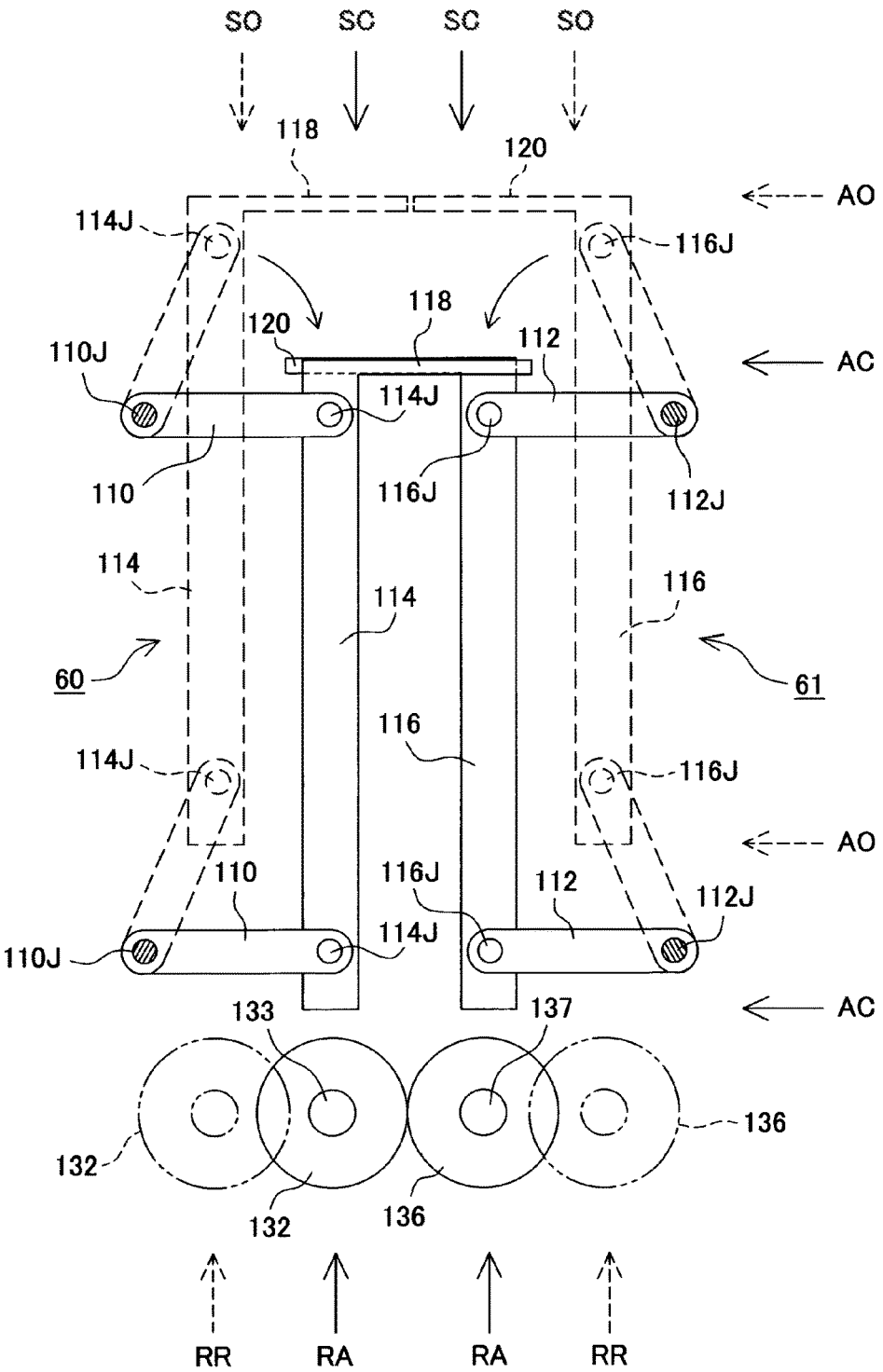
FIG. 6 is a plan explanatory view of a folding mechanism of the folding unit of FIGS. 4 and 5.
Figure 7:
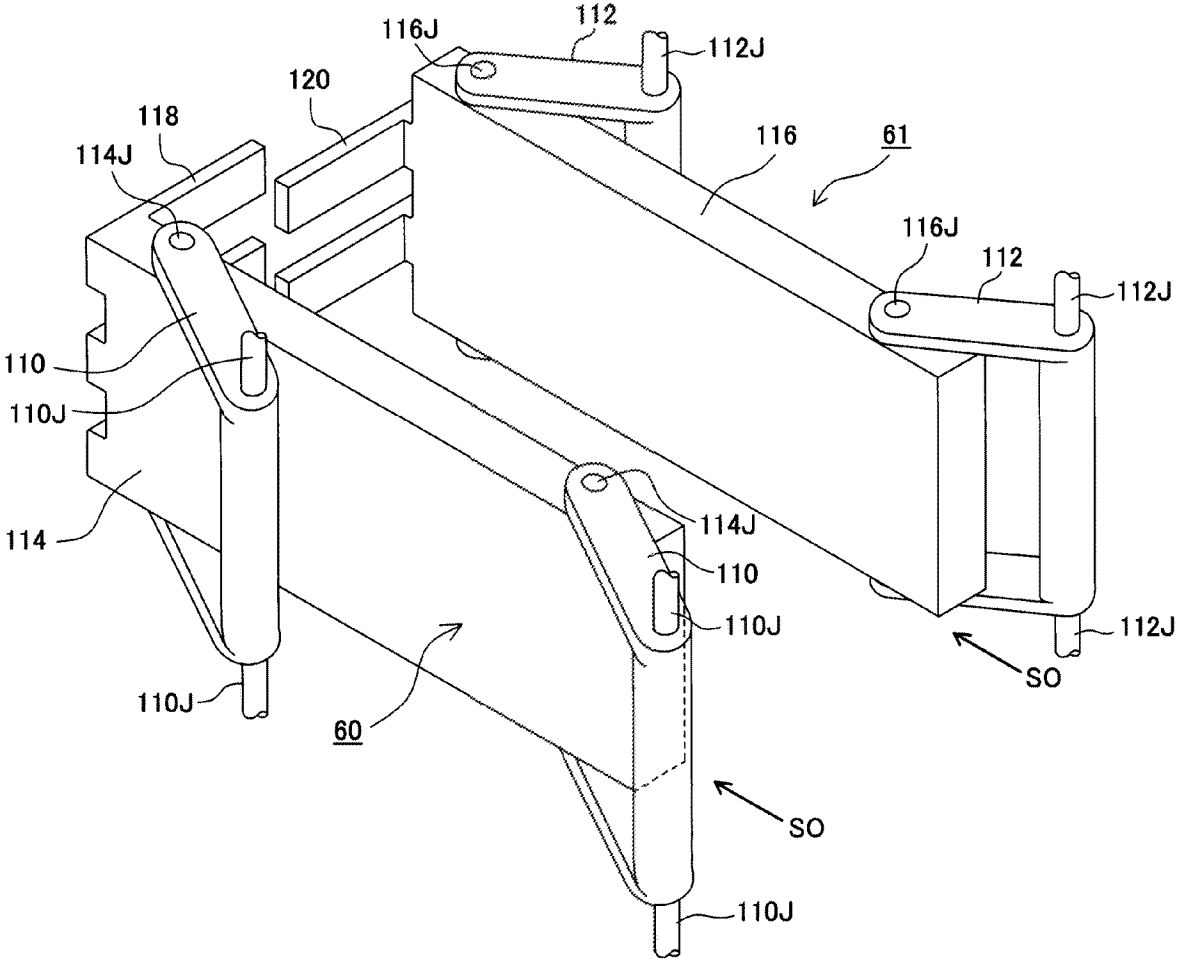
FIG. 7 is a perspective view of shift portions before pressing a sheet of a substantially cylindrical shape of FIG. 6.
Figure 8:
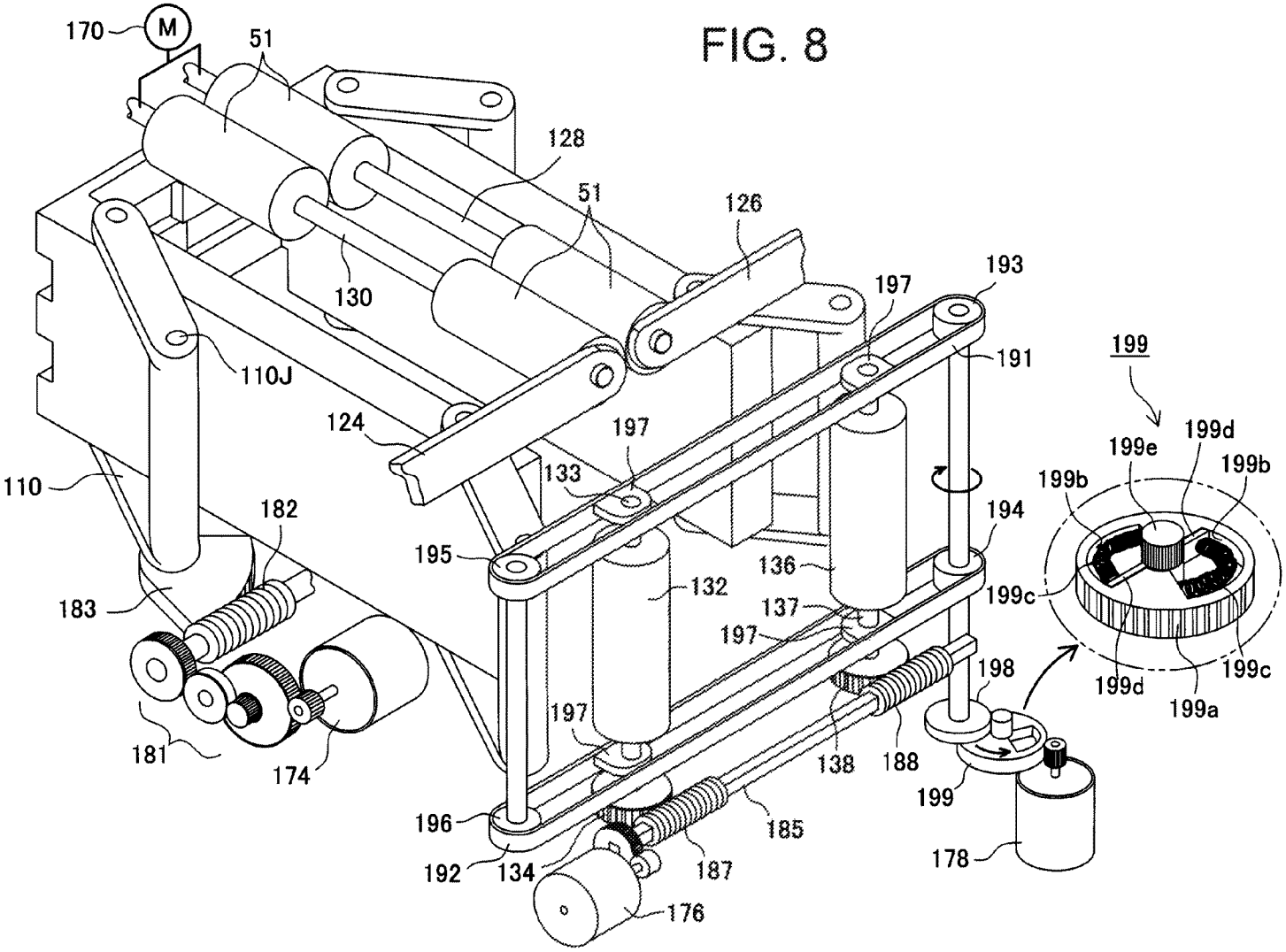
FIG. 8 is an explanatory view illustrating a drive relationship between the shift portions and folding rollers shown in FIGS. 4 to 7.

FIG. 6 is a plan explanatory view of the shift portions (left shift portion 60, right shift portion 61) of the folding unit 31, FIG. 7 is a perspective view of the left shift portion 60 and right shift portion 61 of FIG. 6, and FIG. 8 is a drive explanatory view including the left folding roller 132 and right folding roller 136.

[Rear End Push-Out Portions of the Shift Members]

As described previously, FIG. 6 illustrates, as a plan view, that each of the shift members (left shift portion 60, right shift portion 61) has the rear end push-out member (left rear end push-out portion 118, right rear end push-out portion 120) which is formed of an L-shaped member, and engages in the rear end edge in the discharge direction of the sheet to push out in making the sheet of the substantially cylindrical shape the substantially flat shape and shifting the sheet in the discharge direction. Further, FIG. 7 shows a perspective view of only the shift members (left shift portion 60, right shift portion 61).

As can be understood from these figures, it is also shown that each of the left shift plate 114 of the left shift portion 60 and the right shift plate 116 of the right shift portion 61 is positioned in the shift plate release position SO positioned to support the sheet in the substantially cylindrical shape in the substantially cylindrical shape formation section 57, and in the shift plate pressing position SC for pressing the sheet of the substantially cylindrical shape from the direction crossing the width direction to make the substantially flat shape.

In the shift plate release positions SO, the left rear end push-out portion 118 and right rear end push-out portion 120 are positioned in a substantially linear shape. When the sheet completes entry into the substantially cylindrical shape formation section 57 and is made the substantially cylindrical shape, the portions deform the sheet and shift to the shift plate pressing positions SC. In the positions, the left rear end push-out portion 118 and right rear end push-out portion 120 are formed mutually in the shape of a comb so as to overlap each other (see FIG. 7). This shape is made to prevent the portions from colliding with each other in the shift plate pressing positions SC, and to enable the portions to approach each other sufficiently to make the substantially flat shape.

Further, in the shift of the shift members (left shift portion 60, right shift portion 61) from the shift plate release position SO to the shift plate pressing position SC, the left rear end push-out portion 118 and right rear end push-out portion 120 shift to the folded sheet exit 145 side of the left folding roller 132 and right folding roller 136. This is caused by that in the frame, the left shift plate 114 is rotatably attached to the left link portion 110 rotating about the left link shaft 110J, and that the right shift plate 116 is rotatably attached to the right link portion 112 rotating about the right link shaft 112J as described previously.

Accordingly, when each of the shift members (left shift portion 60, right shift portion 61) shifts from the shift plate release position SO to the shift plate pressing position SC, an end portion on the folded sheet exit 145 side of each of the shift members (left shift portion 60, right shift portion 61) also shifts from an exit separate position AO to an exit close position AC. By this operation, the sheet supported in the substantially cylindrical shape in the substantially cylindrical shape formation section 57 is deformed into the substantially flat shape, and shifts while being deformed into the substantially flat shape between the left folding roller 132 and the right folding roller 136.

[Folding Rollers (Left Folding Roller 132, Right Folding Roller 136)]

As described previously, near the folded sheet exit 145, the left folding roller 132 is disposed on the side opposite to the left rear end push-out portion 118, and the right folding roller 136 is disposed on the side opposite to the right rear end push-out portion 120. The left folding roller 132 and right folding roller 136 are also configured to shift between positions of folding roller separate positions RR for separating from each other to receive the sheet made the substantially flat shape, and folding roller press-contact positions RA for coming into press-contact with each other to fold the sheet. Accordingly, after the sheet becoming the substantially cylindrical shape by the shift members (left shift portion 60, right shift portion 61) shifts to a position to be nipped between the left folding roller 132 and the right folding roller 136, the left folding roller 132 and the right folding roller 136 come into press-contact with each other and are driven to rotate.

Referring to FIG. 8, described herein are drive mechanisms including the left shift portion 60, right shift portion 61, left folding roller 132 and right folding roller 136.

First, in the carry-in rollers 50, a left roller shaft 130 is supported by a rear-side frame not shown of the folding unit 31 and a left roller support arm 124 that supports on the front side (folded sheet discharge side), and a right roller shaft 128 is supported by the frame and a right roller support arm 126. By this means, the carry-in rollers 51 are driven by a transport drive motor 170 together with the entrance rollers 45 and exit rollers 47 shown in FIG. 5.

[Configuration and Drive Mechanism of the Shift Members]

The shift members (left shift portion 60, right shift portion 61) shift by rotating a sector gear 183 individually provided integrally in the left link portion 110 that shifts the left shift plate 114. For the sake of convenience, FIG. 8 illustrates the drive mechanism of the left shift plate 114 of the left shift portion 60.

In other words, drive of an approach/separation motor 174 of the shift plate is transferred to a transmission worm gear 182 via a transmission gear 181. The above-mentioned sector gear 183 rotates by drive rotation of the transmission worm gear 182, and it is thereby possible to shift the left link plate 110 between the shift plate release position SO and the shift plate pressing position SC.

The right shift portion 61 is drive-transferred in a lower position where the shift members (left shift portion 60, right shift portion 61) overlap, and also shifts in synchronization by the same configuration.

[Configuration and Drive Mechanism of the Folding Rollers]

Described next is separation/contact of the folding rollers (left folding roller 132, right folding roller 136) and a mechanism of drive rotation for folding the sheet of the substantially flat shape.

First, for folding-roller separation/contact, a left folding roller shaft 133 of the left folding roller 132 and a right folding roller shaft of the right folding roller 136 are individually provided in respective shaft support portions 197 of an upper shift belt 191 laid between upper pulleys 193, 195 and a lower shift belt 192 laid between lower pulleys 194, 196 in lower and upper opposite positions in the shaft direction.

Accordingly, by driving a folding roller separation/contact motor 178, the left folding roller 132 and right folding roller 136 move in directions for coming into press-contact with each other by rotation in one direction, and by rotation in the other direction, it is possible to shift the rollers in directions for separating from each other. In the rotation arrow between the upper pulley 193 and the lower pulley 194 in FIG. 8, the rollers shift in directions for coming into press-contact with each other.

Further, in order to obtain a predetermined press-contact force to fold a sheet, the left folding roller 132 and right folding roller 136 are provided with a configuration of an intermediate gear 199, shown by the enlarged figure of alternate long and two short dashes line, between the folding roller separation/contact motor 178 and a transmission gear 198 attached to a shaft for driving the upper pulley 193 and lower pulley 194.

The intermediate gear 199 is comprised of two gears including an outer drive side gear 199*a* to which drive of the folding roller separation/contact motor 178 is directly transferred, and a spring receiving gear 199*e* with the same axis as the gear 199*a* to engage in the transmission gear 198. Springs 199*c* existing in spring receiving portions 199*b* cut in the drive side gear 199*a* are disposed between the drive side gear 199*a* and the spring receiving gear 199*e*. One end of the spring 199*c* comes into contact with an inner wall of the drive side gear 199*a* by the spring receiving 199*b*, and the other end comes into contact with the spring receiving portion integrally formed with the spring receiving gear 199*e*.

By this configuration, when the left folding roller 132 and right folding roller 136 are not in contact, the spring 199*c* is not compressed and rotates. Then, when the left folding roller 132 and right folding roller 136 are brought into contact with each other, the drive side gear 199*a* compresses the spring 199*c* to drive. Compression of the spring 199*c* acts as a force for bringing the left folding roller 132 and right folding roller 136 into press-contact with each other, and the press-contact force to fold a sheet is generated.

In addition, although the folding roller separation/contact motor 178 in FIG. 8 is shown on the discharge side, as the apparatus, the motor is disposed below the folding roller.

The configuration for driving and rotating the left folding roller 132 and right folding roller 136 in the discharge direction will be described next, successively using FIG. 8.

The left folding roller 132 and right folding roller 136 are driven by the folding roller drive motor 176. Drive of the folding roller drive motor 176 drives and rotates a rectangular shaft 185 extending in the same direction as the lower shift belt 192 via a transmission gear. By rotation of the rectangular shaft 185, a left slide worm gear 187 and right slide worm gear 188 rotate. By this means, the left slide worm gear 187 drives a left folding roller gear 134 of the left folding roller 132, and the right slide worm gear 188 drives a right folding roller gear 138 of the right folding roller 136.

In this case, even when the left folding roller 132 and right folding roller 136 shift between the roller press-contact positions RA for mutually coming into press-contact and the roller separate positions RR for separating, drive transfer is formed by the rectangular shaft 185, and therefore, by sliding the rectangular shaft, it is possible to perform drive transfer.

[Pressing of the Substantially Cylindrical Sheet to the Substantially Flat Shape]

Hereinafter, referring to FIGS. 9 and 10, described is a state in which a sheet held in the substantially cylindrical shape in FIGS. 4, 5 and 7 is pressed in the substantially flat shape by the shift members (left shift portion 60, right shift portion 61).

Figure 9:
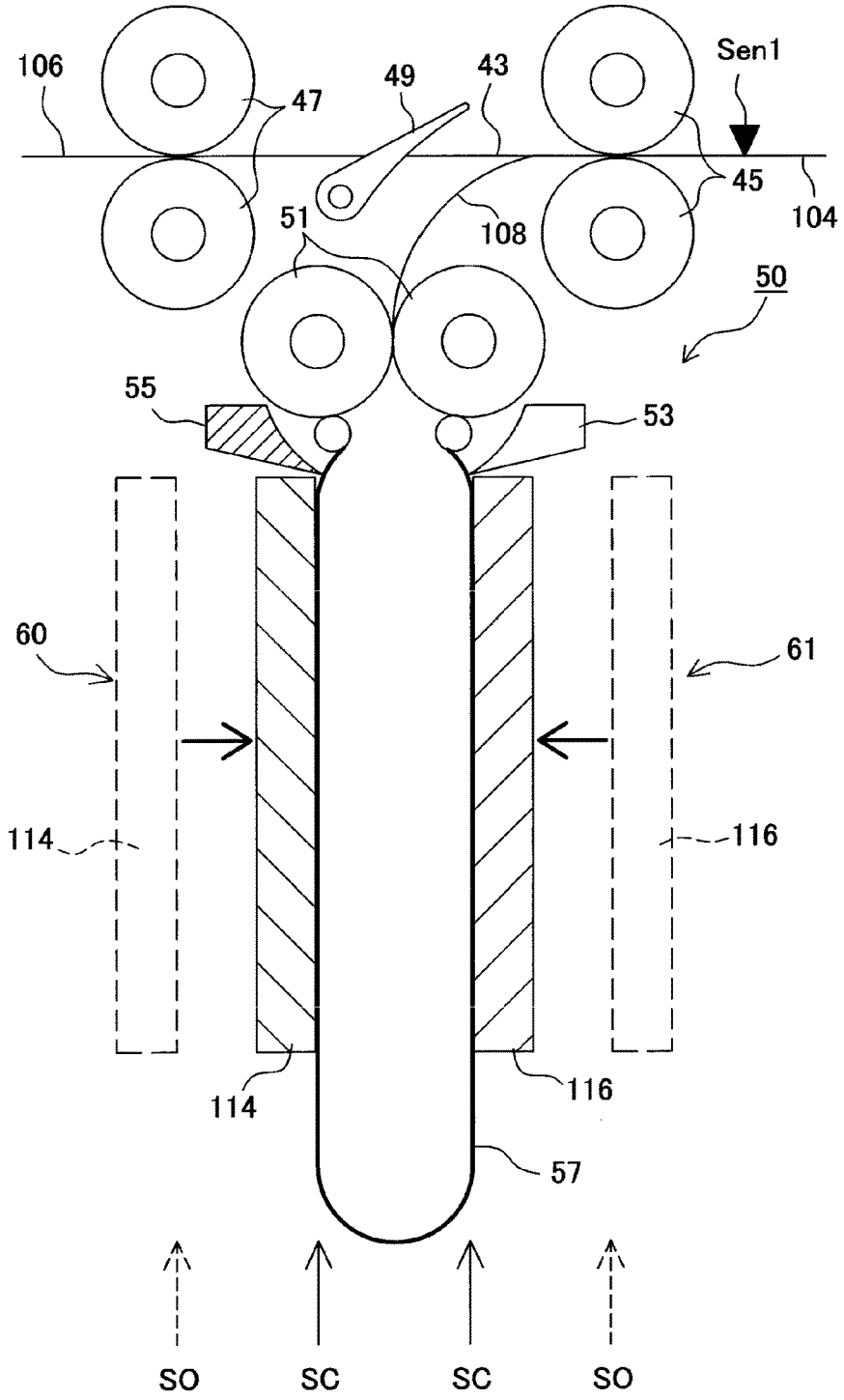
FIG. 9 is a cross-sectional explanatory view where the shift portions of FIG. 7 press the sheet of the substantially cylindrical sheet into a flat shape.

As shown in FIG. 9, by driving the approach/separation motor 174 of the above-mentioned shift plates, the left shift plate 114 of the left shift portion 60 and the right shift plate 116 of the right shift portion 61 shift the sheet formed in the substantially cylindrical shape in the substantially cylindrical shape formation section 57 from the shift plate release positions SO to the shift plate pressing positions SC for mutually approaching. By the shift to the shift plate pressing positions SC, since the outer guide 57*a* and inner guide 57*b* of the substantially cylindrical shape formation section 57 are made of flexible sheet film materials, as shown in the figure, the shape is changed to the substantially flat shape extending downward. By this means, the held sheet is also changed from the substantially cylindrical shape to the substantially flat shape. In this change, since the rear end of the sheet held in the substantially cylindrical shape is regulated by the carry-in rollers 51, the sheet changes to the elliptical shape extending downward and becomes the substantially flat shape.

In addition, although the figure omits the inner guide 57*b* of the substantially cylindrical shape formation section 57, the inner guide 57*b* also changes similarly. Further, as described previously, the inner guide 57*b* may be omitted.

Figure 10:
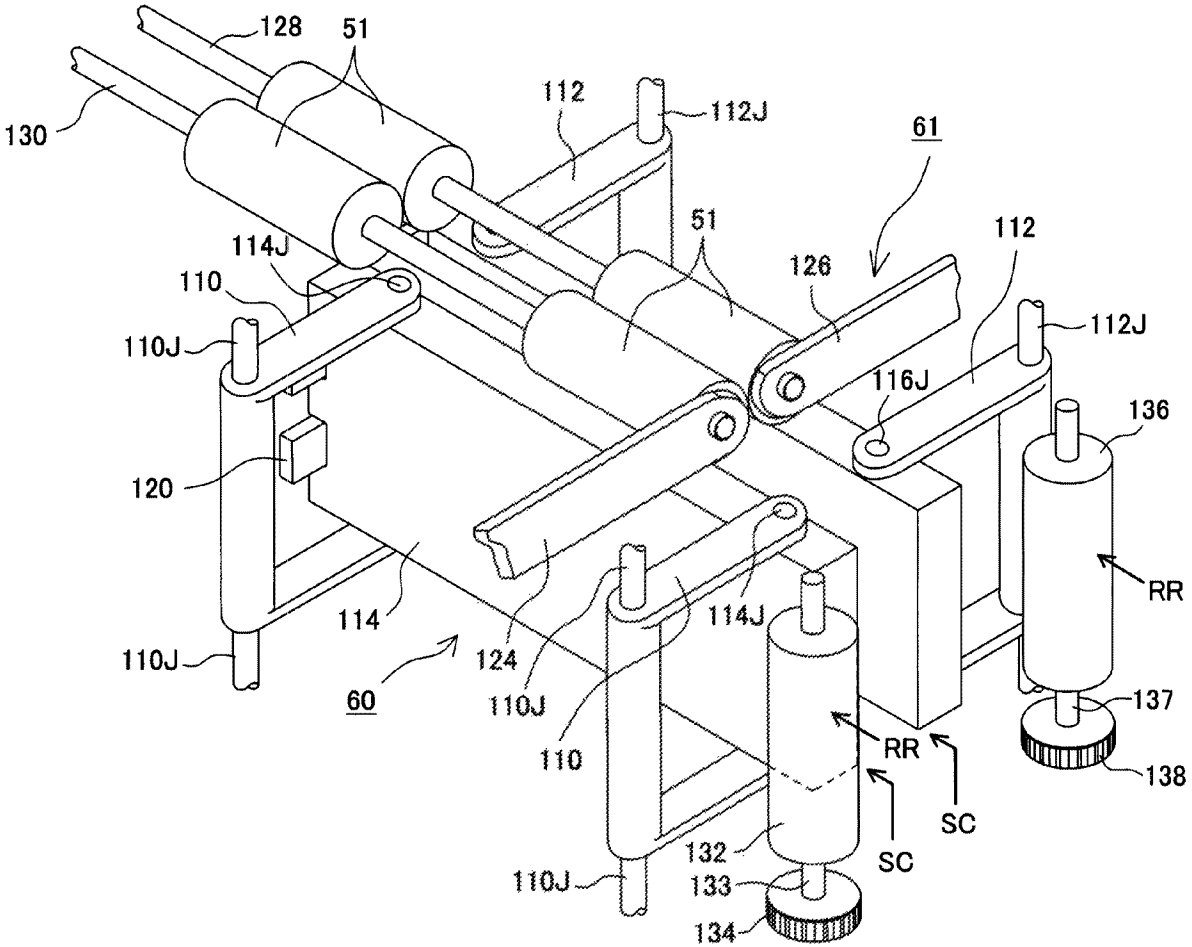
FIG. 10 is a perspective view of the shift portions that press the sheet of the substantially cylindrical shape of FIG. 9 into a substantially flat shape.

FIG. 10 is a perspective view of the shift members (left shift portion 60, right shift portion 61) of FIG. 9. This figure illustrates a state in which the sheet is changed from the substantially cylindrical shape to the substantially flat shape in a state in which the left link portion 110 and right link portion 112 of FIG. 7 are shifted, and shift the left shift plate 114 and right shift plate 116 from the shift plate releasing positions SO to the shift plate pressing positions SC. This state illustrates the same state as in the figure where the left link portion 110 and right link portion 112 in FIG. 6 described already are shifted from the dashed-line positions to the solid-line positions.

Further, the shift of the shift members (left shift portion 60, right shift portion 61) deforms the sheet of the substantially cylindrical shape into the substantially flat shape, while shifting the sheet to between the folding rollers (left folding roller 132, right folding roller 136) existing in the roller separate positions RR. After the sheet of the substantially flat shape is positioned in left folding roller 132 and right folding roller 136, at this point, the rollers are shifted to the roller press-contact positions RA by driving the folding roller separation/contact motor. In this way, the sheet is transported by the carry-in rollers 51, and is made the substantially cylindrical shape in the substantially cylindrical shape formation section 57. Next, the sheet is deformed from the substantially cylindrical shape to the substantially flat shape by the shift members (left shift portion 60, right shift portion 61), and is shifted to between the left folding roller 132 and the right folding roller 136.

Furthermore, the rear end edge push-out portion 118 and right rear end push-out portion 120, which engage in the sheet rear end edge in the discharge direction of the substantially cylindrical shape, are formed in the shape of a comb to mutually overlap, and as shown in FIG. 10, the right rear end push-out portion 120 integrally formed with the right shift plate 116 is shown on the left shift plate 114 end side.

Figure 11:
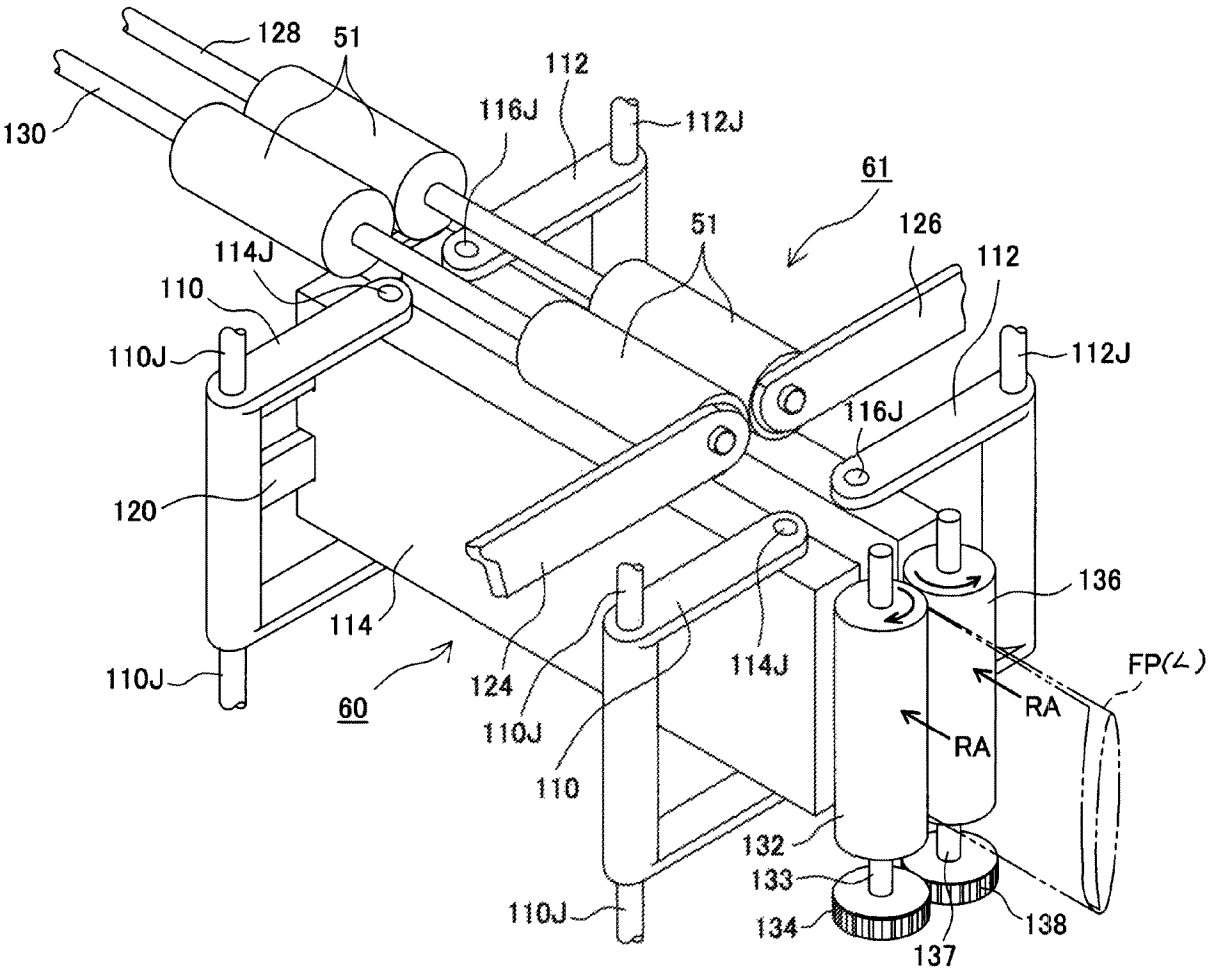
FIG. 11 is a perspective view illustrating a state for folding the sheet made the substantially flat shape of FIG. 10, while discharging.

Referring to FIG. 11, described next is a state for discharging the sheet made the substantially flat shape in FIG. 10 while folding. As described above, for the sheet of the substantially cylindrical shape made the substantially flat shape positioned between the left folding roller 132 and the right folding roller 136, at this point, the left folding roller 132 and the right folding roller 136 are shifted to the roller press-contact positions SC of FIG. 10 by driving the folding roller separation/contact motor 178, and are given the press-contact force to fold by the mechanism of the intermediate gear described in FIG. 8. Subsequently, the left folding roller 132 and the right folding roller 136 are driven to rotate by the folding roller separation/contact motor 178, and fold the sheet made the substantially flat shape to discharge. This state is shown by left winding folded sheet FP (L) of alternate long and two short dashes line in FIG. 11.

In the stage for discharging while performing folding processing by press-contact rotation of the left folding roller 132 and right folding roller 136, at this point, the left link portion 110 and right link portion 112 are returned. Then, the shift members (left shift portion 60, right shift portion 61) shift to the shift plate releasing positions SO, return the substantially cylindrical shape formation section 57 to the substantially cylindrical shape, and prepare for carry-in of the next sheet. In addition, the sheet winding direction will be described later in FIGS. 16A and 16B.

[Substantially Cylindrical Sheet and Folded Sheet]

Figure 12B:
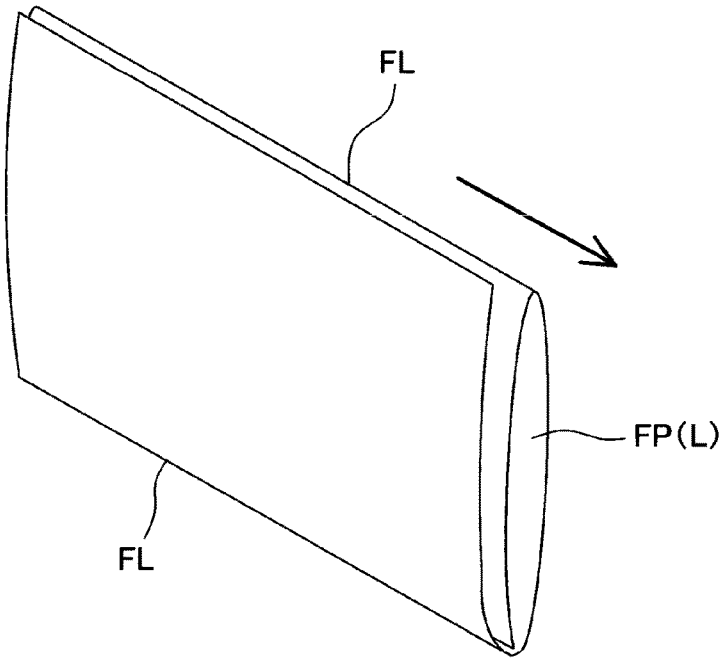

Referring to FIGS. 12A and 12B, described herein is a state of the folded sheet generated in the substantially cylindrical shape folding section (folding processing section) 50 described in the foregoing.

FIG. 12A illustrates a state in which a sheet is held in the substantially cylindrical shape as described in FIGS. 4, 5 and 7 previously, and in this figure, the sheet transported by the carry-in rollers 51 is transported while rotating, and is formed in the substantially cylindrical shape that apart thereof overlaps one another in the substantially cylindrical shape formation section 57. The sheet is formed in the left winding folded sheet CP (L). When the folding processing is performed in this overlapping state, generally known inward three-fold is made.

FIG. 12B is an explanatory view illustrating a state in which the left folding roller 132 and right folding roller 136 shown in FIG. 10 perform the folding processing in a press-contact state. The left winding substantially cylindrical sheet CP (L) in the substantially cylindrical shape shown in FIG. 12A is made the substantially flat shape, and by folding subsequently, the left winding folded sheet FP (L) is shown.

In addition, although it is repeated, the "substantially cylindrical shape" in the invention refers to a substantially cylindrical shape in the shape shown in above-mentioned FIG. 12A, and it is assumed that the "substantially flat shape" refers to a sheet in the shape, which is an intermediate shape between FIGS. 12A and 12B, narrow in the horizontal direction and extended in the vertical direction with a narrower distance than the substantially cylindrical shape obtained by pressing the substantially cylindrical sheet of almost elliptical cross section from the opposite sides. The meaning of the intermediate shape is essentially only that the diameter is made narrower than the substantially cylindrical shape to permit the narrowed sheet of the substantially cylindrical shape to enter into between the left folding roller 132 and the right folding roller 136 positioned in the roller separate positions RR.

[Folded Sheet Storage Tray]

Figure 13:
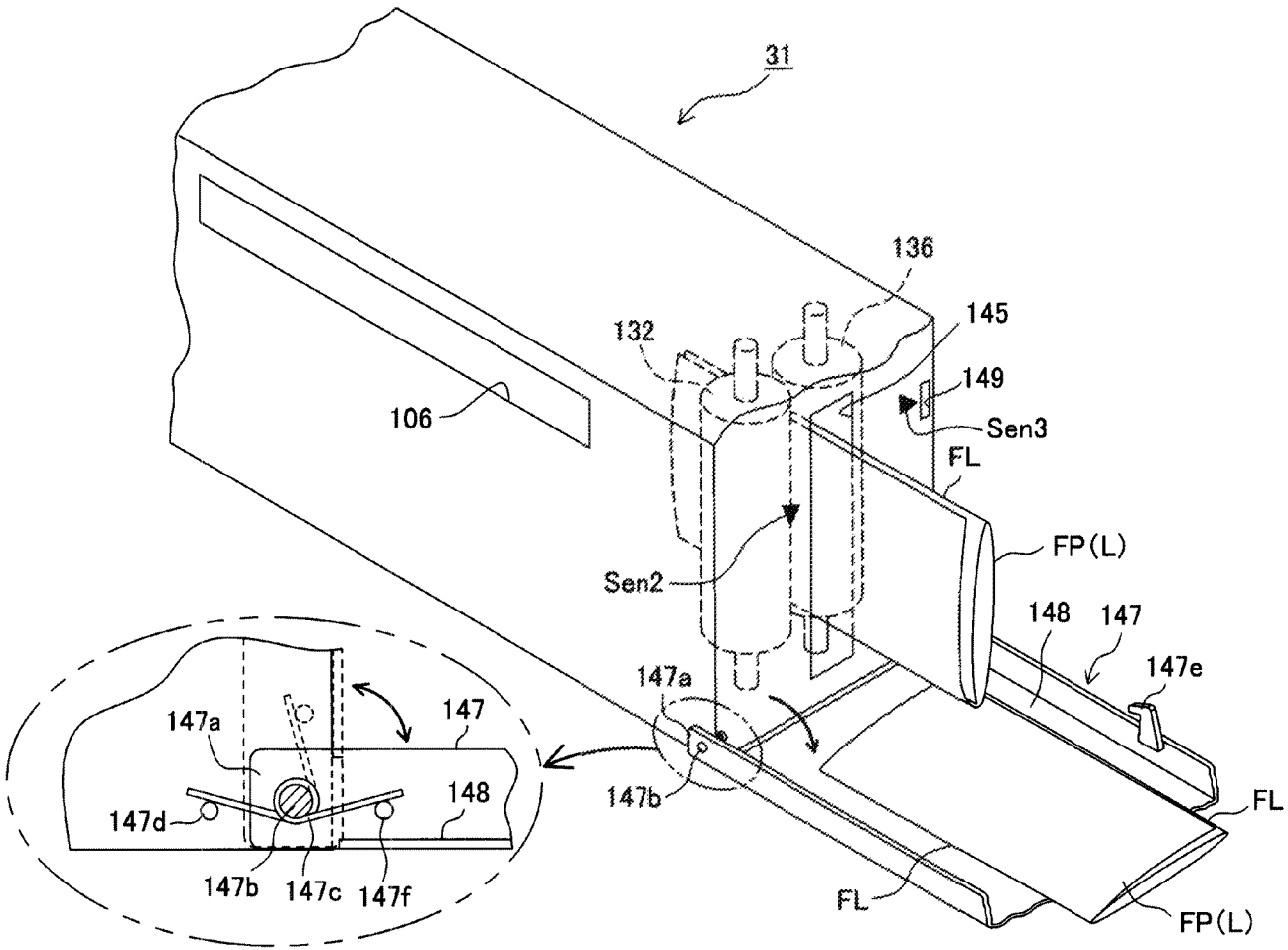
FIG. 13 is a perspective view illustrating a state for collecting a folded sheet discharged from the folding unit while being folded by folding rollers.

Referring to FIG. 13, described next is a state for storing a folded sheet that is discharged from the folding unit 31, while being folded by the left folding roller 132 and the right folding roller 136. As in the figure, on the folded sheet discharge side of the folding unit 31 is provided the folded sheet exit 145 cut in the frame of the unit. The folded sheet exit 145 is provided with a folding unit cover 147 that shifts between a position for covering the frame of the folding unit 31 and a release position shown in the figure.

As shown in the enlarged figure of alternate long and two short dashes line, the folding unit cover 147 is provided with a frame attachment portion 147*a* to attach to the frame of the folding unit 31, and a rotating shaft 147*b* on the frame side for rotating and supporting the frame attachment portion 147*a*. On the rotating shaft 147*b*, a release spring 147*c* for always biasing the folding unit cover 147 to the release direction is laid between a frame-side stopper 147*d* of the folding unit 31 and a stopper pin 147*f* of the folding unit cover 147. This configuration is the same on the opposite side of the folding unit 31.

Further, the surface of the folding unit cover 147 opposed to the folded sheet exit 145 is made a folded sheet tray portion 148 that stores folded sheets discharged from the folded sheet exit 145. Accordingly, without providing a discharge tray separately, as shown in FIG. 13, the sheet drops onto the folding sheet tray portion 148 on the backside of the folding unit cover 147 under its own weight and is stored.

Further, in the folding unit cover 147 on the side opposite to the frame attachment portion 147*a* is provided a locking hook 147*e* that enters a locking hole 149 on the frame side. The locking hook 147*e* is locked by a lock mechanism that shifts by a solenoid or the like, not shown, provided inside the locking hole 149, when the folding unit 31 is not used.

Accordingly, when a folding control section 211 (control section) described later is configured to operate the lock mechanism, release locking and release the folding unit cover 147 in performing folding processing, the cover functions as indication of operation of the folding unit 31 and the folded unit tray, and convenience is enhanced.

Further, in the locking hole 149 is provided a folding unit cover sensor Sen3 that detects the locking hook 147*e* of the folding unit cover 147. The folding unit cover sensor Sen3 detects the locking hook 147*e* as a detection flag, and in the case of detecting the locking hook 147*e* when the folding unit 31 is instructed to operate, is to release the lock mechanism.

On the other hand, as another case, in the case where a user releases the folding unit cover 147, when it is configured that the folding control section 211 (control section) determines that the section is instructed to execute the folding processing, operates a switching flapper solenoid 172 so as to guide the sheet to the substantially cylindrical shape folding section 50 shown in FIGS. 3 and 5 and causes the switching flapper 49 to enter the folding transport path 43, it is also possible to execute the folding processing by release of the folding unit cover 147.

[Switch of the Winding Direction in the Substantially Cylindrical Shape Formation Section 57]

Referring to FIGS. 14 to 17B, described next is switch of the winding direction in the substantially cylindrical shape formation section 57 of the sheet made the substantially cylindrical shape in the substantially cylindrical shape folding section 50. By the switch of the winding direction, it is possible to change whether the front cover of the folded sheet is the frontside or backside of the sheet subjected to the folding processing with ease, being more useful.

Figure 14:
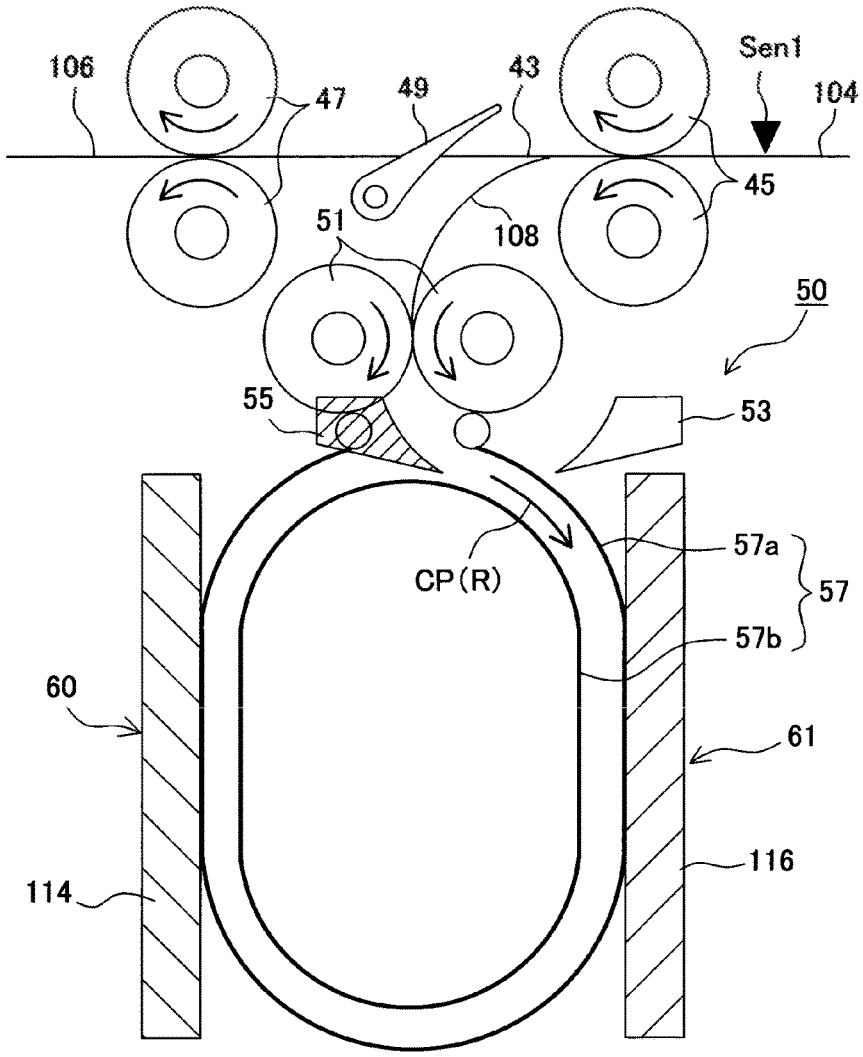
FIG. 14 is a cross-sectional explanatory view to constitute a cylindrical sheet by winding in a winding direction of the sheet in the substantially cylindrical shape opposite to a direction in FIG. 5.

FIG. 14 is an explanatory view of cross section constituting the substantially cylindrical sheet by winding the sheet in the substantially cylindrical shape formation section 57 in the winding direction opposite to the direction in FIG. 5. Herein, for convenience in description, a different respect from FIG. 5 will be described mainly, and the other description herein will be omitted by referring to FIG. 5.

In FIG. 5, the sheet transported by the carry-in rollers 51 is guided to the substantially cylindrical shape formation section 57 by the first gate 53 as a guide gate. Therefore, the sheet is shown as the left winding substantially cylindrical sheet CP (L) in the counterclockwise direction.

In contrast thereto, in the sheet shown in FIG. 14, the sheet is wound around the substantially cylindrical shape formation section 57 by the second gate 55 provided in a position opposed to the first gate 53. By this means, as shown in FIG. 14, the sheet transported by the gate 55 is a right winding substantially cylindrical sheet CP (R) in the same direction as the clockwise direction in the substantially cylindrical shape formation section 57.

Figure 16A:
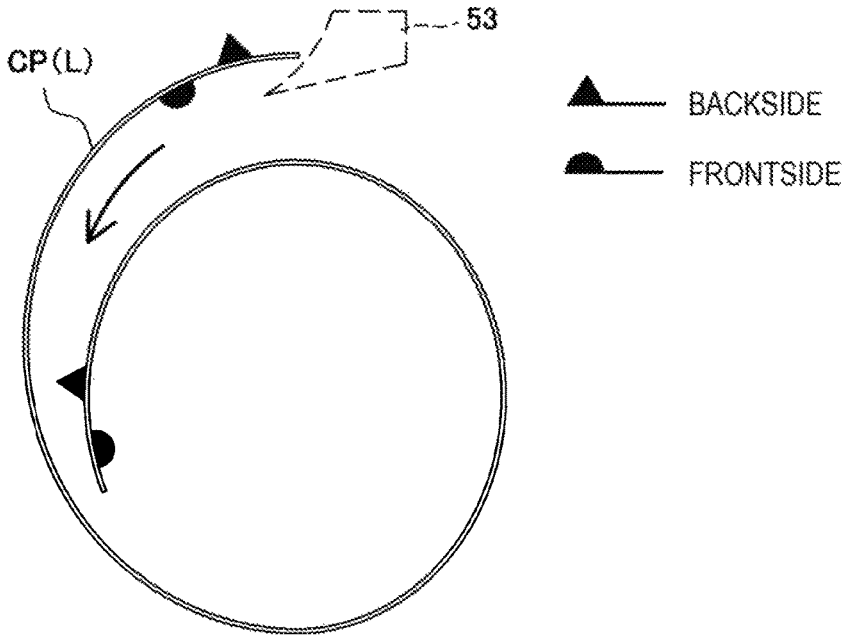
FIGS. 16A and 16B contain views to explain a relationship between a winding state in the substantially cylindrical shape and frontside/backside of a sheet, where
Figure 16B:
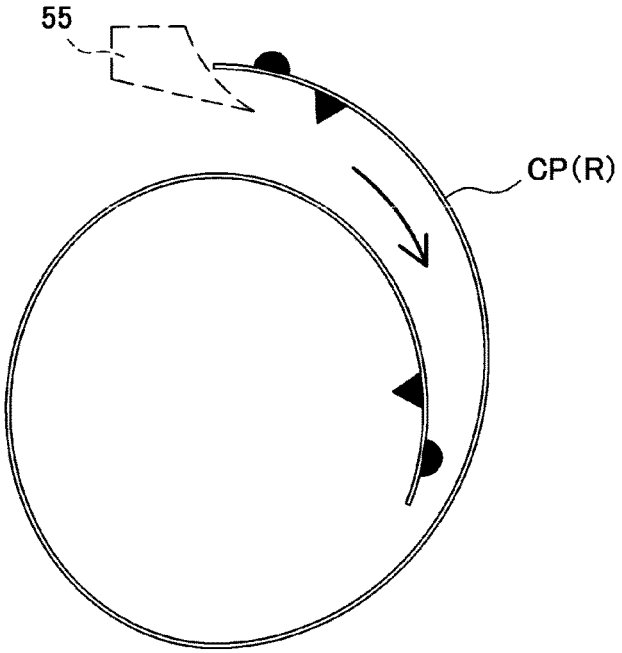

In the above-mentioned difference, as shown in FIGS. 16A and 16B, it is possible to select the surface of the frontside or backside with the image formed as the frontside or backside of the folded sheet. The image formation apparatus A shown in FIG. 1 or 2 discharges with the frontside being the lower side, and delivers the sheet to the subsequent sheet processing apparatus B including the folding unit 31 and binding unit 32. By this means, in FIGS. 16A and 16B, the sheet from the carry-in rollers 51 is also carried in the same order of frontside and backside. In the invention, it is used guiding using the first gate 53 or second gate 55 positioned between the carry-in rollers 51 and the substantially cylindrical shape folding section 50 (substantially cylindrical shape formation section 57), and thereby changing the sheet winding direction in the substantially cylindrical shape formation section 57.

First, in FIG. 16A, using the first gate 53 shown in FIG. 5, the sheet is transported and guided to the substantially cylindrical shape formation section 57. In this way, the sheet forms the left winding substantially cylindrical sheet CP (L) in the counterclockwise direction. By this means, the sheet is wound with the image-formed frontside being the inner side, and in the case of forming a folded sheet, as shown in FIGS. 12A and 12B, the left winding folded sheet FP (L) is formed. The folded sheet is inward three-fold, and the folded lines FL appear.

Figure 17B:
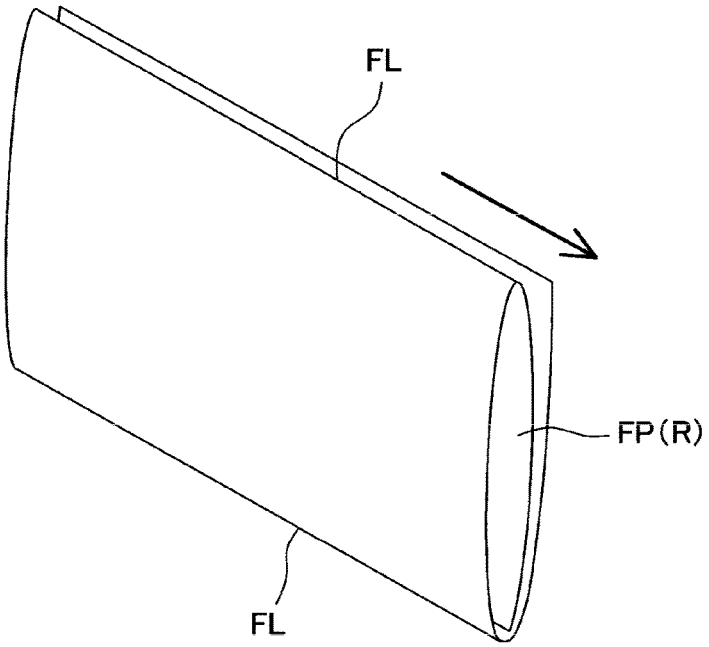

On the other hand, in FIG. 16B, using the second gate 55 shown in FIG. 14, the sheet is transported and guided to the substantially cylindrical shape formation section 57. In this way, at this point, conversely, the sheet forms the right winding substantially cylindrical sheet CP (R) in the clockwise direction. By this means, the sheet is wound with the image-formed frontside being the outer side, and in the case of forming a folded sheet, as shown in FIGS. 17A and 17B, the right winding folded sheet FP (R) is formed. The folded sheet is also inward three-fold, and the folded lines FL appear similarly.

Thus, by using the first gate 53 or the second gate 55 as a guide gate to determine the winding direction of the substantially cylindrical shape formation section 57, it is possible to select the front side of the folded sheet.

In addition, the above-mentioned description shows the example where the image formation apparatus A discharges the image-formed frontside downward, but it is possible to apply also to an apparatus that discharges the image-formed frontside upward, conversely. It is essential only that the winding direction in the substantially cylindrical shape formation section 57 is configured to be selected to enable the frontside and backside to be changed.

[Switch Mechanism of the Guide Gate (First Gate 53, Second Gate 55)]

Figure 15:
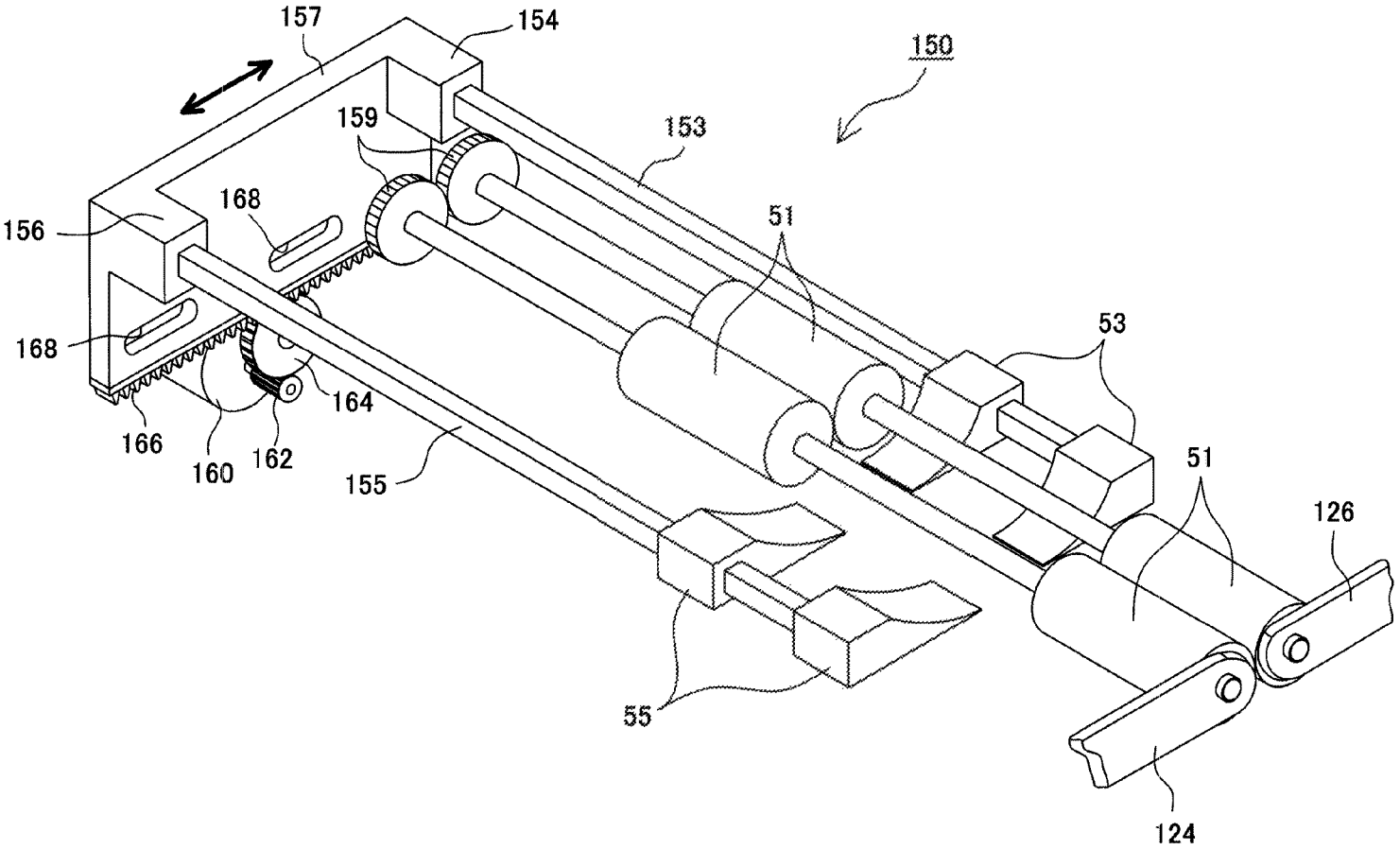
FIG. 15 is a mechanism explanatory view of guide gates in FIGS. 5 and 14.

Herein, a switch mechanism of the guide gate for switching the winding direction around the substantially cylindrical shape formation section 57 in the substantially cylindrical shape folding section 50 described in the foregoing will be described, backing to FIG. 15.

As shown in the figure, the first gate 53 and second gate 55 are made a unit and are supported by a guide gate unit 150. As described in the foregoing, the first gate 53 and second gate 55 are positioned between the carry-in roller 51 and the substantially cylindrical shape formation section 57 not shown, and any of the gates moves back and forth from the direction crossing the transport direction of the carry-in roller 51.

The selective back-and-forth is comprised of the following mechanism. First, the first gate 53 is supported by a first gate attachment portion 154 of a gate support plate 157 with a first gate support shaft 153 made of a rectangular shaft. Then, the second gate 55 is supported by a second gate attachment portion 156 of the gate support plate 157 with a second gate support shaft 155 made of a rectangular shaft. Accordingly, the first gate 53 and second gate 55 are attached to the same gate support plate 157.

The gate support plate 157 is provided with a support plate rack 166 integrally attached below, and the support plate rack 166 meshes with a drive motor pinion 164 via a drive shaft 162 of a gate switch motor 160. The gate switch motor 160 is attached to a rear-side frame of the folding unit 31, is a motor capable of rotating forward and backward, and by rotation in one direction, shifts the gate support plate 157 to cause the first gate 53 to enter.

Further, by rotation in the other direction of the gate switch motor 160, the gate support plate 157 is shifted in the direction opposite to the above-mentioned direction, and it is possible to retract the first gate 53 and cause the second gate 55 to enter. Two shift guide holes provided in the gate support plate 157 engage in pins protruding in the rear-side frame of the folding unit 31, not shown particularly, and are to shift and guide the gate support plate in the horizontal direction as shown in the figure.

In addition, the reason why both the first gate 53 and the second gate 55 are cantilever support as shown in the figure is to prevent the gate from interfering with discharge in discharging a folded sheet. In this way, the first gate 53 and second gate 55 are supported by the gate support plate 157 disposed on the rear side of the folding unit 31, and are configured as the guide gate unit 150 to facilitate the switch.

[Description of a Control Configuration]

A system control configuration of the image formation apparatus A provided with the sheet processing apparatus B including the folding unit 31 as the above-mentioned sheet folding apparatus will be described according to a block diagram of FIG. 18. An image formation apparatus system shown in FIGS. 1 and 2 is provided with an image formation control section 200 of the image formation apparatus A and a sheet processing control section 205 (control CPU) of the sheet processing apparatus B including the guide unit 30, folding unit 31, binding unit 32 and tray unit 33. The image formation control section 200 is provided with a paper feed control section 202 and input section 203. Then, from a control panel 204 provided in the input section 203 is performed setting of a sheet processing mode such as "print mode", "sheet folding mode (including folded sheet front side setting)" and "sheet binding mode" described later.

The sheet processing control section 205 is a control CPU that operates the sheet processing apparatus B corresponding to the designated sheet processing mode as described previously. The sheet processing control section 205 is provided with ROM 206 storing operation programs, and RAM 207 storing control data. Further, to the sheet processing control section 205 are input signals from a various sensor input section 208 of the sheet carry-in sensor Sen1 that detects a sheet transported near the entrance roller 45, a folded sheet carrying-out sensor Sen2 that detects discharge of a folded sheet near the folded sheet exit 145, the folding unit cover sensor Sen3 that detects whether or not the folding unit cover 147 is released, for example, with respect to the folding unit 31 according to the present invention, a paper surface level sensor that detects a paper surface level so as to detect a sheet load amount on the collection tray 90, and the like.

Next, the sheet processing control section 205 is provided with a sheet transport control section 210 that controls sheet transport of each unit of the guide unit 30, folding unit 31, binding unit 32 and tray unit 33. Further, the sheet processing control section 205 is provided with a folding control section 211 that performs sheet folding processing in the folding unit 31, a processing tray control section 212 that controls the alignment plates 84 and the like in placing on the processing tray 79 to perform binding in the binding unit 32, and a stapler control section 213 that controls the stapler 80 that performs binding processing on a bunch of sheets placed on the processing tray 76.

Particularly, the folding control section 211 (control section), which controls the folding unit 31 according to the present invention, controls the gate switch motor 160 which selects and shifts the gate support plate to determine the winding direction by using the first gate 53 or the second gate 55 that is a guide gate to guide to the substantially cylindrical shape formation section 57 of the substantially cylindrical shape folding section 50. Further, the folding control section 211 (control section) controls a transport drive motor 170 that drives the entrance rollers 45, exit rollers 47 and carry-in rollers 51, and the switching flapper solenoid 172 that shifts the switching flapper 49 to select whether or not a sheet is guided to the folding introduction path 108 and is guided to the carry-in rollers 51 from the folding transport path 43.

Further, the folding control section 211 (control section) controls the (shift plate) approach/separation motor 174 that shifts the shift members (left shift portion 60, right shift portion 61) to deform the substantially cylindrical shape formation section 57 of the substantially cylindrical shape folding section 50 from the substantially cylindrical shape to the substantially flat shape, the folding roller separation/contact motor 178 that separates or brings the folding rollers (left folding roller 132 and right folding roller 136) into press-contact from/with each other to further fold the sheet made the substantially flat shape, and the folding roller drive motor 176 that drives the folding rollers to rotate.

Figure 18:
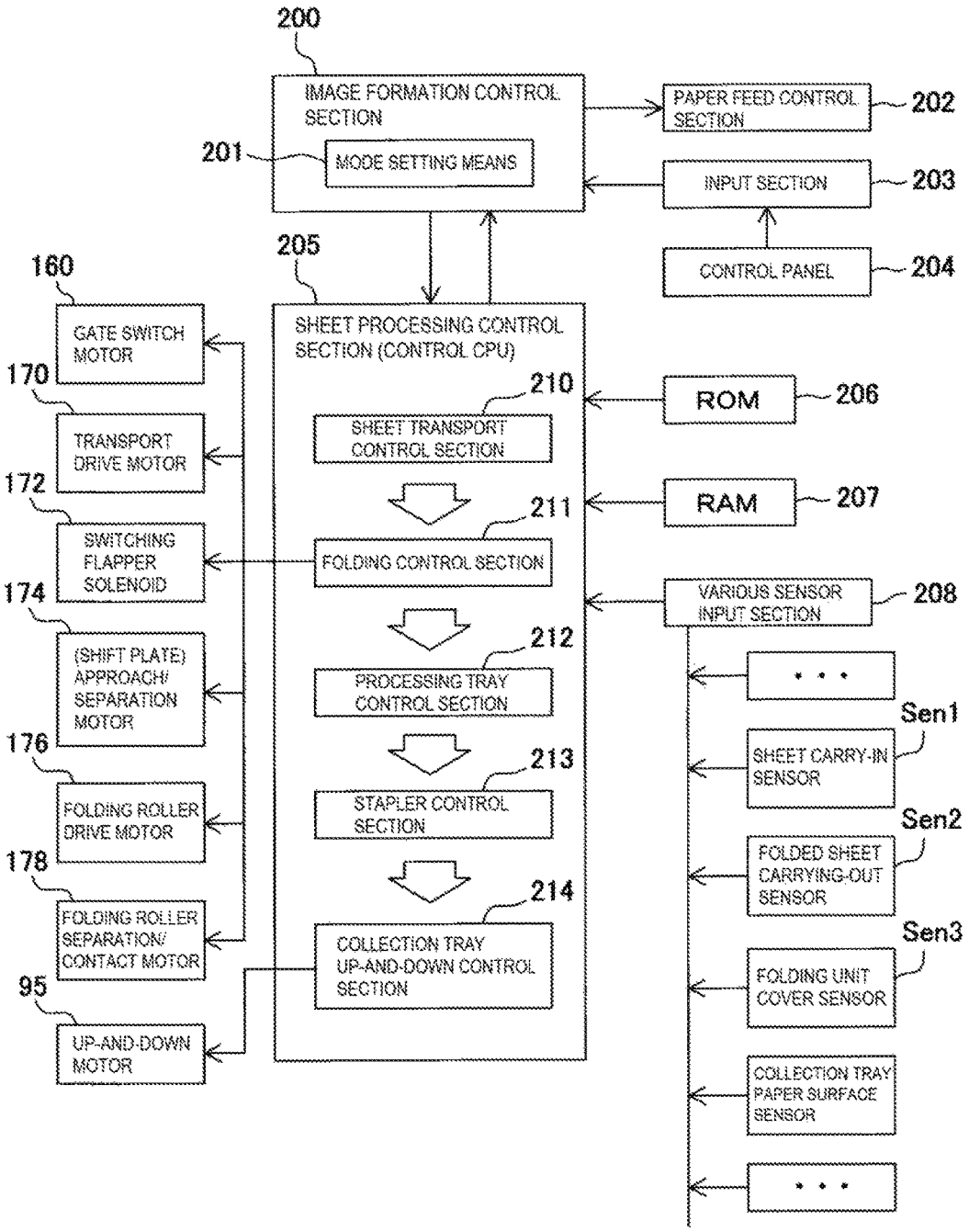
FIG. 18 is an explanatory view of a control configuration in the entire configuration of FIGS. 1 and 2.

Furthermore, although not shown in FIG. 18, when the folding control section 211 (control section) is configured to control to operate the lock mechanism by a solenoid or the like in the folding unit cover 147 described in FIG. 13 and to release the folding unit cover 147, the cover functions as indication of operation of the folding unit 31 and as the folding unit tray, and convenience is enhanced.

Still furthermore, when the section is instructed to operate the folding unit 31, in the case where the unit cover sensor Sen3 detects the locking hook 197*e*, it is also possible to release the lock mechanism.

Moreover, as control of another case, as described already, in the case where a user releases the folding unit cover 147, when it is configured that the folding control section 211 (control section) determines that the section is instructed to execute the folding processing by release of the locking hook 197*e* with the unit cover sensor Sen3, operates the switching flapper solenoid 172 so as to guide the sheet to the substantially cylindrical shape folding section 50 shown in FIGS. 3 and 5 and causes the switching flapper 49 to enter the folding transport path 43, it is also possible to execute the folding processing by release of the folding unit cover 147.

Further, the sheet processing control section 205 is provided with a collection tray up-and-down control section 214 that controls the up-and-down motor 95 based on a detection signal from the paper surface level sensor for ascent/descent of the collection tray 90.

[Sheet Processing Mode]

The sheet processing control section 205 of this Embodiment configured as described above causes the sheet processing apparatus B to execute, for example, the "print mode", "sheet folding mode (including folded sheet front side setting)", "sheet binding mode" and the like. The processing mode will be described below.

(1) "Print-Out Mode"

An image-formed sheet is received from the main-body discharge outlet 16 of the image formation apparatus A, and the sheet is stored on the collection tray 90 on a sheet-by-sheet basis with the bunch discharge roller 86 via the binding carry-in roller 72 and carrying-out roller 74.

(2) "Sheet Folding Mode"

A sheet from the transport path 37 of the guide unit 30 is transported to the substantially cylindrical shape folding section of the folding unit 31 to perform simple sheet folding, and the folded sheet is discharged to the apparatus front side crossing the sheet transport direction of the transport path 37.

In addition, together with the sheet folding mode setting, it is set which side of the image-formed sheet is the front side of the folded sheet as shown in FIGS. 16A and 16B. When there is no setting, the state of FIG. 16A is made the initial setting.

(3) "Sheet Binding Mode"

Image-formed sheets from the main-body discharge outlet 16 are temporarily placed as a bunch on the processing tray 76 of the binding unit 32 via the guide unit 30 and folding unit 31, and this bunch is bound by the stapler 80, and is then collected on the collection tray 90.

According to the Embodiments to carry out the invention as described above, the following effects are exhibited.

According to the disclosure herein, the sheet folding apparatus (folding unit 31) for folding a sheet is provided with a hold member (substantially cylindrical shape formation section 57) that holds a transported sheet in a substantially cylindrical shape, shift members (left shift portion 60, right shift portion 61) that press the outer circumferential surface of the sheet of the substantially cylindrical shape held by the hold member to make a substantially flat shape, and a discharge section (left folding roller 132, right folding roller 136) that further presses the sheet made the substantially flat shape by the shift members, while discharging in the outer circumferential edge direction of the sheet.

According to the disclosure, it is possible to provide a relatively compact sheet folding apparatus capable of performing folding processing without using a transport path along a sheet length and three folding rollers in press-contact, with the folding mechanism for pressing a sheet held in the substantially cylindrical shape into the substantially flat shape, while discharging.

Further, according to another disclosure, the sheet folding apparatus (folding unit 31) for folding a sheet is comprised of a transport roller (carry-in roller 50) that transports a sheet, a hold member (cylindrical shape formation section 57) made of a deformable flexible sheet that overlaps the front end and the rear end of the sheet transported by the transport roller to hold in the substantially cylindrical shape, folding rollers (left folding roller 132, right folding roller 136) positioned in a sheet end portion of the hold member to come into press-contact with the sheet held in the substantially cylindrical shape by the hold member to rotate, while being capable of separating from each other, and shift members (left shift portion 60, right shift portion 61) which press the sheet of the substantially cylindrical shape held by the hold member from opposite sides of the sheet outer circumferential surface together with the hold member to deform into the substantially flat shape, while shifting to the folding rollers side.

According to the disclosure, it is possible to provide a relatively compact sheet folding apparatus capable of performing folding processing without using a transport path along a sheet length and three folding rollers in press-contact, with the folding mechanism for pressing a sheet held in the substantially cylindrical shape into the substantially flat shape, while discharging.

According to the next disclosure, the sheet folding apparatus (folding unit 31) for folding a sheet is comprised of a transport roller (carry-in roller 51) that transports a sheet, a hold member (cylindrical shape formation section 57) that winds the sheet transported by the transport roller to hold in the substantially cylindrical shape, shift members (left shift portion 60, right shift portion 61) which deform the sheet of the substantially cylindrical shape held by the hold member into the substantially flat shape, folding rollers (left folding roller 132, right folding roller 136) positioned in an end portion of the hold member to fold the sheet made the substantially cylindrical shape by the shift members, and guide gates (first gate 53, second gate 55) positioned between the transport roller and the hold member to switch a sheet winding direction with respect to the hold member.

According to the disclosure, it is possible to provide a sheet folding apparatus which is relatively compact, capable of performing folding processing without using a transport path along a sheet length and three folding rollers in press-contact, with the folding mechanism for pressing a sheet held in the substantially cylindrical shape into the substantially flat shape, while shifting, and which enables frontside/backside change of the folded sheet to be made with ease.

Moreover, according to another disclosure, a sheet folding method of folding a sheet is provided with a hold step of holding a transported sheet in the substantially cylindrical shape, a shift step of pressing the outer circumferential surface of the sheet of the substantially cylindrical shape formed in the hold step to make the substantially flat shape, and a discharge step of further pressing the sheet made the substantially flat shape in the shift step, and folding in the direction crossing the transport direction, while discharging.

According to the disclosure, since the sheet folding method is to press the sheet held in the substantially cylindrical shape in the substantially flat shape, while discharging, it is possible to provide a relatively compact and easy folding method.

In addition, in the description of the effects in the Embodiments in the foregoing, for reference, with respect to each portion of the Embodiments, the member corresponding to each component in the scope of the claims is shown in the parenthesis, or assigned the reference numeral to clarify the relationship between both the portion and the component. As a matter of course, however, the present invention is particularly not limited thereto.

Further, the present invention is not limited to the above-mentioned Embodiments, various modifications thereof are capable of being made in the scope without departing from the invention, and all technical matters included in the technical ideas described in the scope of the claims are subjects of the invention. The Embodiments described previously illustrate preferred examples, a person skilled in the art is capable of achieving various types of alternative examples, corrected examples, modified examples or improved examples from the content disclosed in the present Description, and the examples are included in the technical scope described in the scope of the claims attached herewith.

This application claims priority from Japanese Patent Application No. 2015-213815 filed on Oct. 30, 2015 in Japan, Japanese Patent Application No. 2015-213816 filed on Oct. 30, 2015, Japanese Patent Application No. 2015-213817 filed on Oct. 30, 2015, and Japanese Patent Application No. 2015-213818 filed on Oct. 30, 2015, incorporated herein by reference.

The invention claimed is:

1. A sheet folding apparatus for folding a sheet, comprising:

one hold member adapted to hold a transported sheet in a substantially cylindrical shape;

a shift member adapted to press an outer circumferential surface of the sheet of the substantially cylindrical shape held by the one hold member to make a substantially flat shape; and a discharge section adapted to further press the sheet made the substantially flat shape by the shift member, while discharging in an outer circumferential edge direction of the sheet.

2. The sheet folding apparatus according to claim 1, wherein the one hold member has a length such that ends of the held sheet overlap one another.

3. The sheet folding apparatus according to claim 1, wherein the shift member folds the transported sheet and the one hold member holding the transported sheet.

4. A sheet folding apparatus for folding apparatus for folding a sheet, comprising:

two hold members adapted to hold a transported sheet in a substantially cylindrical shape;

a shift member adapted to press an outer circumferential surface of the sheet of the substantially cylindrical shape held by the two hold members to make a substantially flat shape; and a discharge section adapted to further press the sheet made the substantially flat shape by the shift members, while discharging in an outer circumferential edge direction of the sheet, wherein each of the two hold members is made of a deformable sheet material.

5. The sheet folding apparatus according to claim 4, wherein the two hold members include an outer guide that guides an outside of the transported sheet, and an inner guide that guides an inside of the sheet.

6. The sheet folding apparatus according to claim 4, wherein the shift member is comprised of a plate-shaped press member that presses the outer circumferential surface of the sheet made the substantially cylindrical shape.

7. The sheet folding apparatus according to claim 6, wherein the shift member presses from a direction for nipping the outer circumferential surface of the sheet made the substantially cylindrical shape, while also shifting to a discharge section side.

8. The sheet folding apparatus according to claim 7, wherein the discharge section is comprised of discharge rollers provided in one edge of the outer circumferential surface of the sheet.

9. The sheet folding apparatus according to claim 8, wherein the discharge rollers are provided to be able to approach and separate from each other as a pair, the shift member makes the sheet of the substantially cylindrical shape into the substantially flat shape to enter between the discharge rollers that are separate, and subsequently, the discharge rollers are brought into press-contact with each other and rotate to fold the sheet.

10. A sheet folding apparatus for folding a sheet, comprising:

a transport roller adapted to transport a sheet;

a hold member made of a deformable flexible sheet that overlaps a front end and a rear end of the sheet transported by the transport roller to hold the sheet in a substantially cylindrical shape;

folding rollers positioned in an end portion of the hold member to come into press-contact with the sheet held in the substantially cylindrical shape by the hold member to rotate, while being capable of separating from each other; and a shift member adapted to press the sheet of the substantially cylindrical shape held by the hold member from opposite sides of a sheet outer circumferential surface together with the hold member to deform into a substantially flat shape, while shifting to a folding rollers side.

11. The sheet folding apparatus according to claim 10, wherein the shift member is comprised of plane L-shaped members opposed to each other, and is supported by a link member that operates the L-shaped members to approach and separate from each other.

12. The sheet folding apparatus according to claim 11, wherein the link member is comprised of a sector gear disposed to overlap the hold member to be a pair, and a drive mechanism that drives the gear.

13. The sheet folding apparatus according to claim 10, further comprising:

a guide gate provided between the transport roller and the hold member to switch a sheet winding direction with respect to the hold member.

14. The sheet folding apparatus according to claim 13, wherein the guide gate enables whether the sheet is wound around the hold member in a clockwise direction or in a counterclockwise direction to be selected.

15. The sheet folding apparatus according to claim 14, wherein the guide gate is comprised of a pair of guide gates that selectively enter and retract into/from between the transport roller and the hold member.

16. The sheet folding apparatus according to claim 15, wherein the pair of guide gates are supported by a guide gate unit capable of reciprocating in a direction crossing a sheet transport direction by the transport roller.

17. The sheet folding apparatus according to claim 16, wherein the guide gate unit reciprocates by a gate switch motor disposed on an apparatus rear side, while supporting the guide gate in a cantilever state.

18. A sheet processing apparatus for processing a discharged sheet, comprising:

a folding unit including a folding processing section branched off from a transport path for transporting a sheet to a downstream side to perform folding processing on a sheet;

a binding unit including a binding processing section that performs binding processing on sheets as a bunch obtained by temporarily placing sheets transported from the folding unit; and a tray unit including a collection tray capable of moving up and down to collect a bunch of sheets subjected to the binding processing in the binding unit, wherein the folding processing section is provided with a hold member that holds a sheet fed from the transport path in a substantially cylindrical shape, and folding rollers that fold the sheet made the substantially cylindrical shape by the hold member in a direction crossing a sheet transport direction of the transport path, while discharging.

19. The sheet processing apparatus according to claim 18, wherein the folding processing section is provided with a shift member that presses the sheet made the substantially cylindrical shape by the hold member from opposite sides of an outer circumferential surface to deform into a substantially flat shape, and the folding rollers fold the sheet pressed in the substantially flat shape by the shift member, while discharging in a direction crossing a sheet transport direction of the transport path.

20. The sheet processing apparatus according to claim 19, wherein the folding unit is further provided with a unit cover for covering a side portion of the folding unit in a sheet discharge direction of the folding rollers, and in discharging a folded sheet by the folding rollers, the unit cover is released, while being a storage tray of the folded sheet.

21. The sheet processing apparatus according to claim 20, further comprising:

a control section adapted to detect that the unit cover is released to indicate execution of the folding processing.

22. The sheet processing apparatus according to claim 20, further comprising:

a control section adapted to release locking of the unit cover so that the unit cover is positioned in a release position, when the folding processing section is instructed to execute the folding processing.

23. The sheet processing apparatus according to claim 20, wherein the hold member has a winding length having a range in which the sheet held in the substantially cylindrical shape by the hold member has portions overlapping one another.

24. An image formation apparatus comprising:

an image formation section adapted to form an image on a sheet; and a sheet folding apparatus adapted to fold the sheet from the image formation section, wherein the sheet folding apparatus is provided with a configuration according to claim 1.

25. The image formation apparatus according to claim 24, further comprising:

a reading section adapted to read an image of an original document above the image formation section; and sheet discharge space between the reading section and the image formation section, wherein the sheet folding apparatus is disposed in the sheet discharge space.

* * * * *